US009555943B2

(12) United States Patent
Breen, IV et al.

(10) Patent No.: US 9,555,943 B2
(45) Date of Patent: Jan. 31, 2017

(54) CABLE LACING TIE DEVICES AND METHODS OF USING THE SAME

(71) Applicant: IDEAL Industries, Inc., Sycamore, IL (US)

(72) Inventors: Dennis M. Breen, IV, West Chicago, IL (US); Alan E. Zantout, Sycamore, IL (US); Thomas D. Peterson, Algonquin, IL (US); Peter J. Crichton, Wheaton, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 14/600,557

(22) Filed: Jan. 20, 2015

(65) Prior Publication Data

US 2015/0128384 A1 May 14, 2015

Related U.S. Application Data

(62) Division of application No. 13/269,828, filed on Oct. 10, 2011, now abandoned.

(Continued)

(51) Int. Cl.

| | |
|---|---|
| ***B65D 63/16*** | (2006.01) |
| ***A44B 11/06*** | (2006.01) |
| ***B65D 63/10*** | (2006.01) |

(52) U.S. Cl.

CPC ..... *B65D 63/16* (2013.01); *A44B 11/06* (2013.01); *B65D 63/1063* (2013.01); *Y10T 24/14* (2015.01); *Y10T 24/1498* (2015.01)

(58) Field of Classification Search

CPC ..... B65D 63/16; B65D 63/1063; A44B 11/06; Y10T 24/1498; Y10T 24/14; Y10T 24/4016; Y10T 24/4072; Y10T 24/1416

(Continued)

(56) References Cited

U.S. PATENT DOCUMENTS

| | | | |
|---|---|---|---|
| 134,052 | A | 12/1872 | Gurley |
| 1,044,249 | A | 11/1912 | Ronfet |

(Continued)

FOREIGN PATENT DOCUMENTS

| | | | |
|---|---|---|---|
| WO | 02/31300 | A1 | 4/2002 |

OTHER PUBLICATIONS

ISA/US, International Search Report and Written Opinion issued on PCT Application No. PCT/US14/25284, mailed on Jul. 21, 2014, 9 pages.

(Continued)

*Primary Examiner* — Robert J Sandy
*Assistant Examiner* — Rowland Do
(74) *Attorney, Agent, or Firm* — Greenberg Traurig, LLP

(57) ABSTRACT

Cable lacing tie devices and methods of using the same are disclosed. The cable lacing tie devices include a head assembly and a cable lacing tape. The head assembly being configured to retain a first portion of the cable lacing tape within the head assembly and having a length of the cable lacing tape extending from the head assembly. The head assembly further adapted to retain a second portion of the cable lacing tape extending from the head assembly. The methods of using the cable lacing tie devices to hold together a plurality of objects with a cable lacing tie device include retaining a first portion of a cable lacing tape in a head assembly, looping the cable lacing tape around the plurality of objects and retaining a second portion of the cable lacing tape within the head assembly.

3 Claims, 21 Drawing Sheets

Related U.S. Application Data

(60) Provisional application No. 61/391,851, filed on Oct. 11, 2010.

(58) Field of Classification Search
USPC . 24/16 R, 704.2, 703.5, 16 PB, 17 AP, 17 B, 24/17 R, 18, 28, 115 R, 122.6, 168; 292/307 R, 308, 314, 315, 319, 318, 321, 292/325, 326, 307 A; 70/14, 18, 30, 49, 70/58, 57.1, 53
See application file for complete search history.

(56) References Cited

U.S. PATENT DOCUMENTS 1,962,285 A * 6/1934 Robinson ..... A61B 17/1327 24/191
3,186,047 A 6/1965 Schwester et al.
3,416,198 A 12/1968 Geisinger
3,488,813 A 1/1970 Kohke
3,660,869 A 5/1972 Caveney et al.
3,739,429 A 6/1973 Kohke
3,744,104 A 7/1973 Ford
3,766,610 A 10/1973 Thorsbakken
3,800,450 A 4/1974 Laugherty et al.
3,875,618 A 4/1975 Schuplin
3,875,771 A 4/1975 Reisner
3,886,630 A 6/1975 Emery
3,900,922 A 8/1975 McCormick
3,909,884 A 10/1975 Weckesser
4,008,512 A 2/1977 Prodel
4,038,726 A 8/1977 Takabayashi
4,422,217 A 12/1983 Barrette
4,498,507 A 2/1985 Thompson
4,514,882 A 5/1985 Lavielle
4,680,834 A 7/1987 Andre et al.
4,761,861 A 8/1988 Peles
4,765,032 A 8/1988 Fortsch
4,854,015 A 8/1989 Shaull
4,932,104 A 6/1990 Kowal
4,993,669 A 2/1991 Dyer
5,102,075 A 4/1992 Dyer
5,121,524 A 6/1992 Mortensen
5,193,251 A 3/1993 Fortsch
5,356,417 A 10/1994 Golds
5,544,391 A 8/1996 Hoffman
5,566,427 A 10/1996 Lathrop
5,572,771 A * 11/1996 Kelleghan ..... A44B 11/12 24/170
5,577,395 A 11/1996 Kuykendall
5,669,253 A 9/1997 Higgins
5,802,888 A 9/1998 Parsons
5,979,095 A 11/1999 Schneider et al.
6,044,669 A 4/2000 Levi
6,076,234 A 6/2000 Khokhar et al.
6,128,809 A 10/2000 Khokhar
6,199,412 B1 3/2001 Kennedy
6,230,369 B1 5/2001 Steadman
6,510,717 B1 1/2003 Levi
6,532,631 B2 3/2003 Rohaly et al.
6,648,378 B1 11/2003 Torres et al.
6,684,462 B1 2/2004 Narula et al.
6,763,553 B2 7/2004 Hatch
6,863,855 B2 3/2005 Shilale
6,928,701 B2 8/2005 Hutter, III
7,013,535 B2 3/2006 Tracy
7,121,122 B2 * 10/2006 Levi ..... E05B 67/003 24/170
7,328,487 B2 2/2008 Hoffman et al.
7,406,789 B2 8/2008 Story
7,644,475 B2 1/2010 Canady
7,832,693 B2 11/2010 Moerke et al.
8,307,517 B2 11/2012 Piermayr et al.
8,635,746 B2 * 1/2014 Bellamy ..... A61B 17/1327 24/170
2002/0170151 A1 11/2002 Caveney et al.
2003/0110596 A1 6/2003 Graham et al.
2003/0172499 A1 * 9/2003 Uehara ..... A44B 11/12 24/170
2005/0091801 A1 5/2005 Feschuk
2007/0226961 A1 * 10/2007 Anderson ..... A44B 11/2588 24/170
2007/0240286 A1 * 10/2007 Kawaguchi ..... A44B 11/12 24/191
2010/0306967 A1 12/2010 Geiger
2013/0205545 A1 * 8/2013 Zantout ..... B65D 63/00 24/16 R

OTHER PUBLICATIONS

USPTO, Office Action issued on U.S. Appl. No. 13/838,390 mailed May 7, 2015, 8 pages.
State Intellectual Property Office of the People's Republic of China, Office Action issued on Chinese patent application No. 201180049106.5 dated Mar. 6, 2015, 7 pages.
ISA/US, International Search Report issued on PCT Application No. PCT/US11/55613, dated Feb. 1, 2012, 2 pages.
ISA/US, Written Opinion issued on PCT Application No. PCT/US11/55613, dated Feb. 1, 2012, 4 pages.
European Patent Office, Supplementary European Search Report issued on EP patent application No. 11833205.5, 8 pages.

* cited by examiner

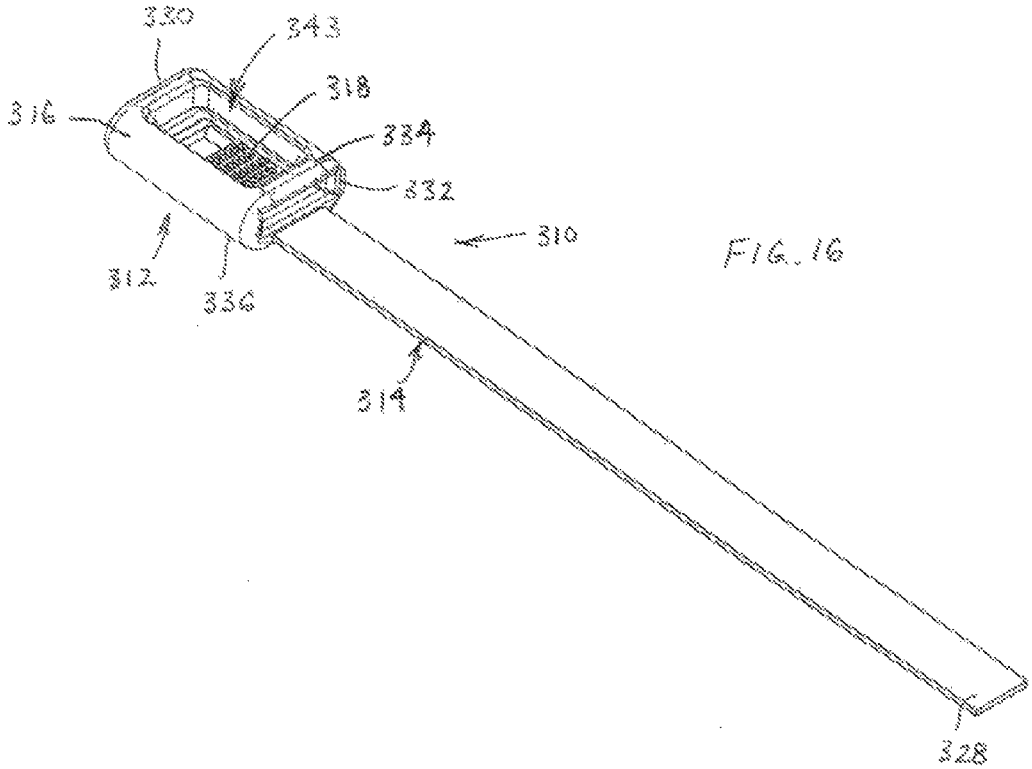
FIG. 16
FIG. 17
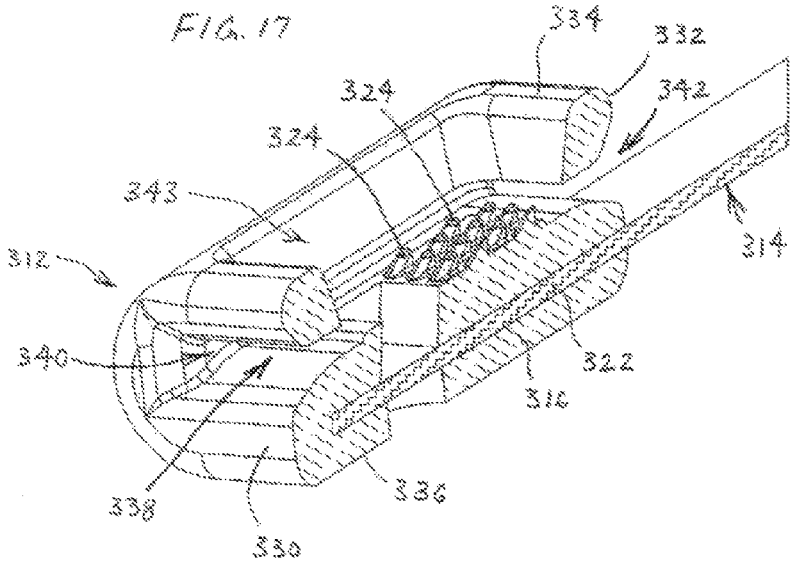

CABLE LACING TIE DEVICES AND METHODS OF USING THE SAME

CROSS REFERENCE TO RELATED APPLICATION

This application is a divisional of U.S. patent application Ser. No. 13/269,828, filed Oct. 10, 2011, entitled "Cable Lacing Tie Devices and Methods of Using the Same," which claims the benefit of U.S. Provisional Patent Application Ser. No. 61/391,851, filed Oct. 11, 2010, the disclosure of each are hereby incorporated by reference in their entirety.

FIELD OF THE DISCLOSURE

The present description relates generally to cable lacing ties and methods of using the same.

BACKGROUND OF RELATED ART

This disclosure relates to devices and methods for holding together two or more wires, wire harnesses, cables or other objects, or for connecting such objects to other structures. More particularly, the disclosure relates to cable lacing tie assemblies for use in bundling a plurality of objects such as wires, wire harnesses, cables or other objects, and methods of using such cable lacing tie assemblies.

Individual wires, wire harnesses or cables having two or more wires or strands are customarily grouped and held adjacent to each other at various points along their lengths by use of cable ties or cable lacing tape. Strapping or tying together such groupings is intended to help ensure the safety and durability of the components.

Cable ties have become very common and typically are formed from an integrally molded piece of plastic that includes an elongated solid strap connected at one end to a buckle. The strap is intended to be looped around a bundle of wires and then fed through a passageway in the buckle. Corresponding surfaces on the strap and within the buckle commonly have complementary serrated patterns that can achieve a locking position. Thus, a cable tie buckle often includes an integrally molded locking element or pawl within the passageway to cooperate with integrally molded serrations or teeth along the strap. The buckle may include a separately provided metal pawl to engage the serrations on the strap. Alternatively, the strap may have flat surfaces and the buckle may include a separately provided metal barb or knife-like strap piercing element to cut or bight into the strap and prevent rearward withdrawal of the strap. However, such a barb or knife like strap piercing element is destructive to the strap when it cuts or bights into the strap, permanently reducing the strength of the strap and increasing the tendency for the strap to tear through.

Once a strap of a cable tie is passed through the buckle, it may be cut to remove the free end. However, the cut section of the molded plastic strap that protrudes from the buckle can present an undesirable, fairly sharp obstruction that may result in abrasion problems with respect to adjacent wire bundles, and may be problematic if one is attempting to pull the wire bundle through an aperture, such as a panel opening. This also can be true of the molded buckle itself, which can be relatively large and may have fairly sharp edges. It should be noted that another drawback of molded plastic cable ties is that, due to their relative rigidity, they generally are not capable of closely hugging irregular or rectangular shapes, as may occur when bundling wires, wire harnesses or cables, or connecting them to other structures.

In the aerospace environment, a cable tie can be subjected to elevated temperatures as high as 400 degrees F. This can cause a common cable tie, which is typically molded from thermoplastic material, such as Nylon, to creep or lose structural integrity. The integral locking element or pawl that engages the strap then may yield, allowing the wire bundle to separate or come loose. The locking element or pawl generally will be constructed to be deflectable, so as to reduce the strap insertion force, but this also compromises the ability to retain the strap, especially at high temperatures. Cable ties that have a separately provided metal locking element or pawl usually are intended to provide for increased retention, even at elevated temperatures, but these structures typically require higher insertion forces when passing over the metal element.

Because of many of the above drawbacks associated with plastic molded cable ties, in areas where elevated levels of safety are required, such as in the military and commercial aircraft industries, the aerospace industry, as well as in some marine environments, there is a preference to use a procedure known as "cable lacing" for securing or bundling wires, wiring harnesses or cables. Cable lacing includes looping a material commonly referred to as "cable lacing tape" around wires, wire harnesses or cables and tying knots in the cable lacing tape, either in discrete locations along the length of the bundle, referred to as spot ties, or in a running format with the cable lacing tape continuing along the bundle between knot locations.

Modern cable lacing tapes typically are a thin, relatively flat, woven or braided cord, often referred to as a "tape", having filaments that may be made of materials such as Nylon, polyester or Nomex, and which may be impregnated with coatings to enhance particular performance characteristics. Materials such as Nomex provide good tensile strength, while being non-flammable, highly resistant to fluids and lubricants, and able to perform in extreme temperature environments, such as from approximately −65 degrees F. to 500 degrees F. However, cable lacing has drawbacks in that the cable lacing tape typically is tied by hand in a costly, labor-intensive, and time-consuming process. Due to these problems, several attempts have been made to automate the cable lacing process. One such device for automated knot tying is described in U.S. Pat. No. 6,648,378.

Such knot tying devices have their own drawbacks and one still is faced with using cable lacing tape that must be cut. Indeed, after forming a spot tie, it is common to cut the ends of the cable lacing tape, so as not to leave them hanging or susceptible to being snagged by other objects. However, cutting the ends of the cable lacing tape may lead to the unraveling of the braided filaments. Therefore, in some installations, it has become common to attempt to fuse the filaments of a cut cable lacing tape end by applying a binding agent, such as a drop of adhesive or glue. The need to incorporate the use of adhesives or glues into the assembly method may present additional difficulties, such as for example cleanliness of the application, unintentional bonding of other objects or surfaces, and the introduction of potentially undesirable fumes, and/or flammable or incompatible fluids or materials.

SUMMARY

The present disclosure provides cable lacing tie devices for holding together a plurality of objects, such as where the plurality may be one or more similar or different objects that are to be gathered and held together at one or more predetermined locations, such as points along a group of wires, wiring harnesses or cables that are gathered together to form a bundle. The cable lacing tie devices are comprised of a low profile head assembly and a length of a braided filament element hereinafter referred to as a cable lacing tape. A first portion, such as a first end of the length of cable lacing tape, may be retained by the head assembly, for example by being connected to or molded within a body of the head assembly through a process known as insert-molding. Insert-molding provides an extremely robust method of joining the braided cable lacing tape to the head assembly. The body of the head assemblies preferably is molded from a material that is adapted for use in a relatively high temperature environment, such as polyetheretherketone (PEEK) or polyetherimide (PEI), although other materials may be used in correspondence with their desired performance characteristics. The head assemblies also include a retainer which may have protrusions, such as in the form of a separate retainer plate that is engaged with the body, or as a compression member, or otherwise formed to have protrusions located on a surface of the body of the head assembly.

In one form, the retainer may have protrusions configured to engage the cable lacing tape by spreading and becoming located between braided filaments. Such protrusions being designed to hook the filaments and resist movement of the cable lacing tape in one direction, which is associated withdrawal of the cable lacing tape from the head assembly. In another form, the retainer may have protrusions configured to increase or apply localized compression to the cable lacing tape to enhance the holding force applied to the tape. Alternatively, the retainer may be molded within the head assembly to provide protrusions along an internal surface. In all forms, the protrusions of the retainer are not intended to be destructive elements, and therefore, they are not intended to pierce, cut or otherwise damage the individual filaments of the cable lacing tape.

As noted above, the head assemblies may include a compression member, and the compression member may include the retainer. A compression member may be configured to urge the cable lacing tape into engagement with an opposed surface of the head assembly. Further, the head assemblies may include a retainer in the form of protrusions that are located on the compression member or on other opposed surfaces within the head assemblies. The compression member also may be a separate component that engages the body or may be integrally formed with or otherwise connected to the body of the head assembly. tape.

Thus, in a first aspect, the disclosure provides a cable lacing tie device having a head assembly and a cable lacing tape; the head assembly retaining a first portion of the cable lacing tape and having a length of the cable lacing tape extending from the head assembly, and the head assembly further comprising a retainer adapted to retain a portion of the length of cable lacing tape extending from the head assembly. In a second aspect, the disclosure provides a cable lacing tie device having a head assembly, a cable lacing tape, and a retainer adapted to urge a portion of the cable lacing tape into a retained position within the head assembly. In a further aspect, the disclosure provides a method of holding together a plurality of objects with a cable lacing tie device, wherein the cable lacing tie device includes a head assembly and a cable lacing tape configured to have a first portion of the cable lacing tape retained within the head assembly and having a length of the cable lacing tape with a second portion extending from the head assembly, the method including the steps of locating the head assembly at or near the plurality of objects, moving the second portion of the cable lacing tape to a position looped around the plurality of objects, and moving the second portion of the cable lacing tape to a position wherein the second portion of the cable lacing tape engages and is retained within the head assembly.

An advantage of the cable lacing tie devices of the present disclosure is that they may be configured to provide smooth and low profile head assemblies to prevent abrasion against adjacent wires, wire harnesses, cables or other objects. The cable lacing tie devices also may include head assemblies and cable lacing tapes that are constructed from one or more materials that are adapted for use in environments that involve relatively high temperatures or other extreme conditions. A weight savings also may be realized over plastic cable ties by using a light weight cable lacing tape that is of braided filament construction. The head assemblies further may be configured to provide near zero insertion force, thus permitting relatively easy insertion of the distal end of the cable lacing tape through the head assembly. The cable lacing tie devices also may be utilized in a method of cable lacing that provides very rapid and secure installation.

While discussed with respect to examples that may be used in particular industries, such as for example commercial or military aircraft, it will be appreciated that the disclosed cable lacing tie devices and methods of using the same may be utilized in other industries or applications, and may be incorporated into other electrical apparatus and systems for use with any objects requiring connection or bundling. Accordingly, while the present disclosure shows and demonstrates various example components, the examples are merely illustrative and are not to be considered limiting. It will be apparent to those of ordinary skill in the art that various cable lacing tie devices, electrical apparatus and systems can be constructed without departing from the scope or spirit of the present disclosure. Thus, although certain examples have been described herein, they are merely illustrative, are not to be considered limiting, and the scope of coverage of this patent is not limited thereto.

BRIEF DESCRIPTION OF THE DRAWINGS

In describing preferred examples, reference is made to the accompanying drawing figures wherein like parts have like reference numerals, and wherein:

FIG. 16 is a perspective view of a fourth example cable lacing tie device in a pre-installed position and with a simplified view of the cable lacing tape.

FIG. 17 is a perspective section view of the cable lacing tie device of FIG. 16 with the device being sectioned parallel to the lacing direction and with a simplified view of the cable lacing tape.

It should be understood that the drawings are not necessarily to scale and that actual embodiments may differ. It also should be understood that the claims are not limited to the particular examples illustrated or combinations thereof.

DETAILED DESCRIPTION

Figure 1A:
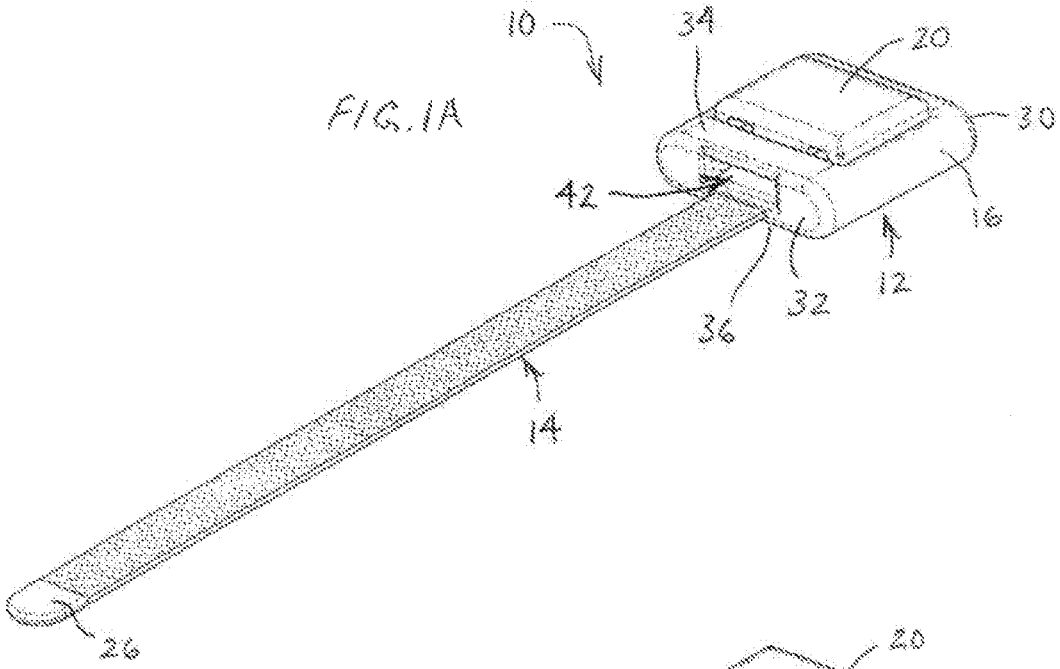
FIG. 1A is a perspective view of a first example cable lacing tie device having a compression member in an unlocked, ready position.
Figure 1B:
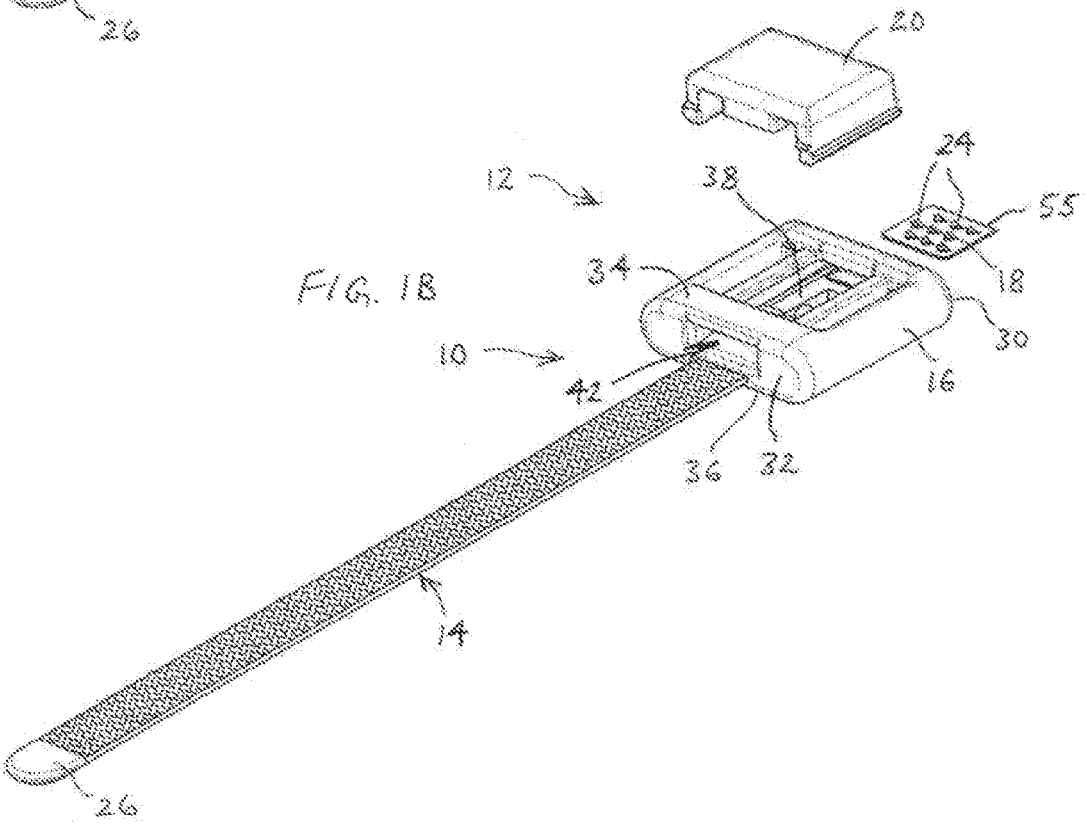
FIG. 1B is a perspective partially exploded view of the cable lacing tie device of FIG. 1.
Figure 2:
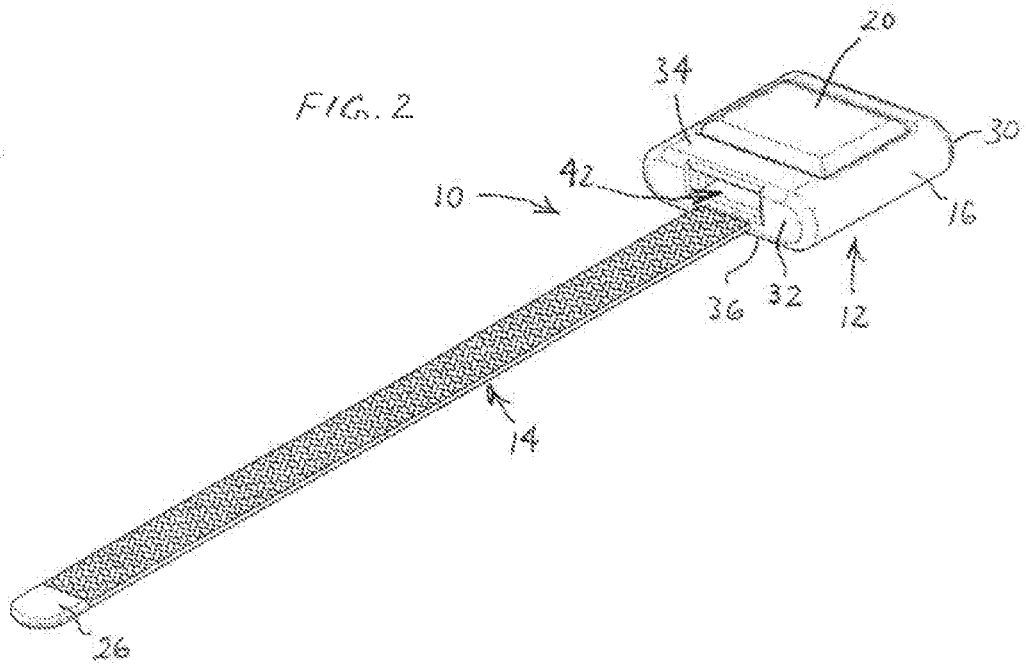
FIG. 2 is a perspective view of the cable lacing tie device of FIG. 1 having the compression member in a locked position.
Figure 3:
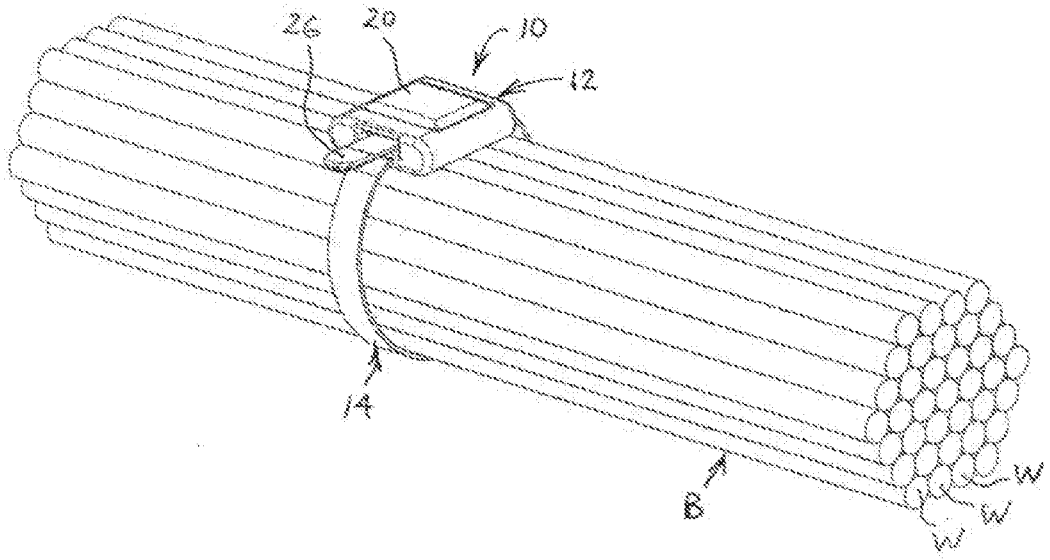
FIG. 3 is a perspective view of the cable lacing tie device of FIG. 1 in an installed position and with a simplified view of the cable lacing tape.
Figure 11:
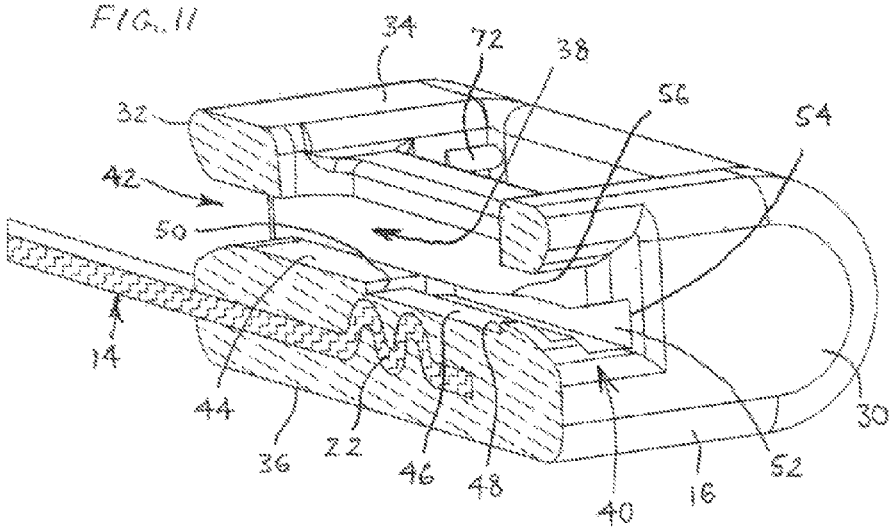
FIG. 11 is a perspective section view of the body of the head assembly of the cable lacing tie device of FIG. 10 with the device being sectioned parallel to the lacing direction and with a simplified view of the cable lacing tape.

A first example cable lacing tie device 10 is illustrated in FIGS. 1A, 1B and 2-11. The cable lacing tie device 10 includes a head assembly 12 and a length of cable lacing tape 14. The head assembly 12 of this example includes a molded body 16, a retainer 18 in the form of a retainer plate, and a compression member 20. A first portion 22 of the cable lacing tape 14 is configured to be retained in a first position within the head assembly 12 by having a first end insert-molded within the body 16 in a tortuous path for enhanced retention, as best seen in FIG. 11. A length of the cable lacing tape 14 then extends from the front of the head assembly 12. The cable lacing tie device 10 may be used, for example, to hold together a plurality of objects, such as to form a bundle B of a group of wires W, which are shown in FIG. 3, in a simplified manner.

The body 16 and compression member 20 preferably each are injection molded and constructed of a material that is suitable for use in a relatively high temperature environment, such as polyetheretherketone (PEEK) or polyetherimide (PEI), although other plastics may be suitable for less demanding environments. The retainer 18, in this example shown in the form of a retainer plate that is preferably formed from a metal, such as spring steel, or other suitable material such as an alloy or a molded composite, includes protrusions 24 that are formed, such as by a stamping process, so as to project upward and at an angle of 90 degrees or less.

Figure 5:
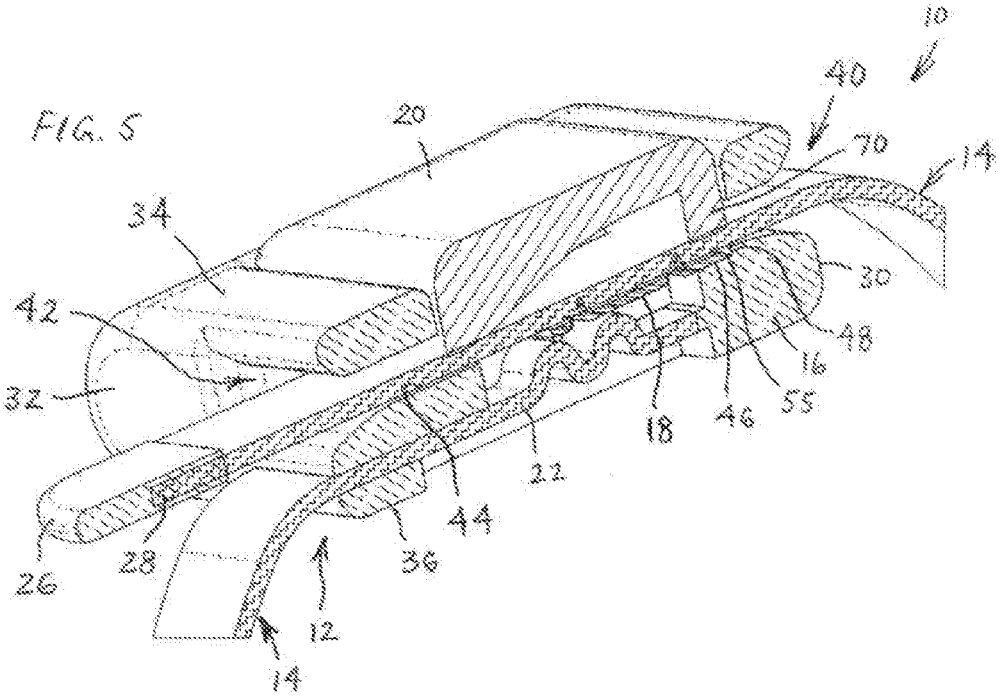
FIG. 5 is a perspective section view of the cable lacing tie device of FIG. 1 having the compression member in an installed position, with the device being sectioned parallel to the lacing direction and with a simplified view of the cable lacing tape.
Figure 6:
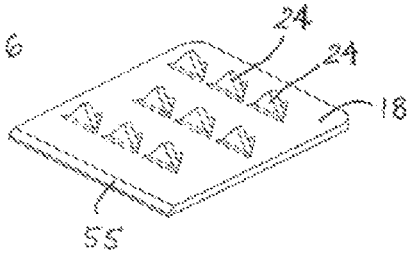
FIG. 6 is a perspective view of a retainer in the form of a retainer plate that is a component of the head assembly of the cable lacing tie device of FIG. 1.

The cable lacing tape 14 preferably is constructed of a thin, relatively flat, braided filament element, such as that known as braided cable lacing tape, which can be made of one or more materials suitable for the intended use. This may include materials such as Nylon, polyester, or natural fibers, but preferably for applications that require a more stable material it may include Nomex, or other suitable modern filaments. The cable lacing tape 14 is illustrated in FIGS. 1A, 1B and 2 in a manner that provides a rough approximation of the appearance of the upper surface of the braided filament element. When the cable lacing tape is depicted in the other Figures, for convenience, it is provided in a very simplified view in which it is represented as a thin, flat band. However, it will be understood that in all of the examples, the cable lacing tape is of a woven or braided filament construction. Here, a first portion 22, such as a first end of the cable lacing tape 14 is retained in the head assembly 12. The cable lacing tape 14 also preferably includes a tip 26 molded to the distal or second end 28 of the cable lacing tape 14 that extends from the head assembly 12, as best seen in FIG. 5. The tip 26 helps to prevent the braided filaments of the cable lacing tape 14 from becoming unraveled, and as discussed in further detail below, facilitates insertion of the second end 28 of the cable lacing tape 14 through the head assembly 12.

Figure 4:
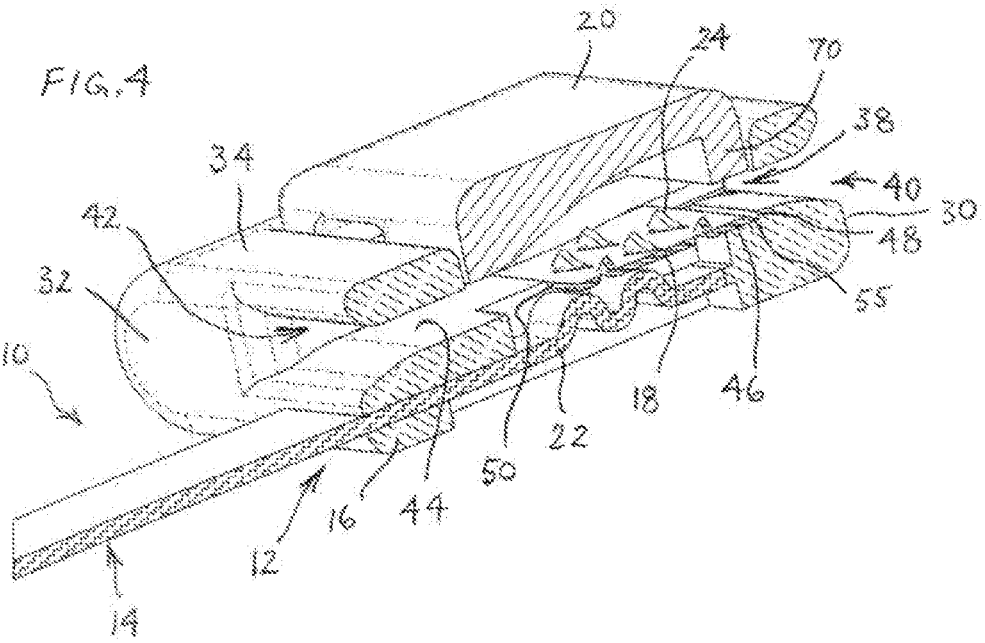
FIG. 4 is a perspective section view of the cable lacing tie device of FIG. 1 having the compression member in an unlocked, ready position, with the device being sectioned parallel to the lacing direction and with a simplified view of the cable lacing tape.

As best seen in FIGS. 2, 4, 9 and 11, the body 16 of the head assembly 12 has a rear surface 30, a front surface 32, a top surface 34, a bottom surface 36, and a passageway 38 having an entrance opening 40 and an exit opening 42. The passageway 38 through the body 16 includes a lower surface 44, and a recess 46 that receives the retainer 18 in the form of a retainer plate. The recess 46 has a rear wall 48 and a front wall 50 that locate the retainer plate 18 in a fore and aft manner. To locate the retainer 18 side-to-side, the body 16 also includes side slots 52 having a rear entrance 54 with a ramped upper surface 56. As the retainer 18 is inserted through the entrance opening 40 of the body 16 and into the rear entrance 54 of the side slots 52, the retainer 18 will bend slightly to allow the center of the retainer 18 to ride over the top of the rear wall 48 while the side edges of the retainer 18 engage and slide within the side slots 52 until the entire retainer 18 is beyond the rear wall 48. At this point, the retainer 18 will tend to return toward its resting condition and assume a position in the bottom of the recess 46. To prevent the potential of the rear of the retainer 18 riding up the rear wall 48 and backing out of the recess 46, as best seen in FIG. 4, the retainer 18 includes a rear edge 55 that preferably is coined or otherwise formed so as to be angled slightly downward.

Figure 7:
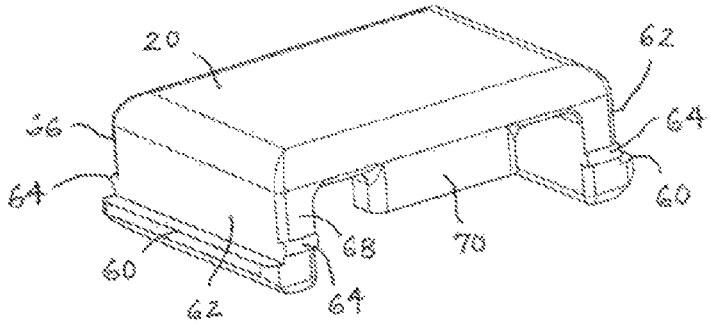
FIG. 7 is a perspective view of a compression member that is a component of the head assembly of the cable lacing tie device of FIG. 1.
Figure 8:
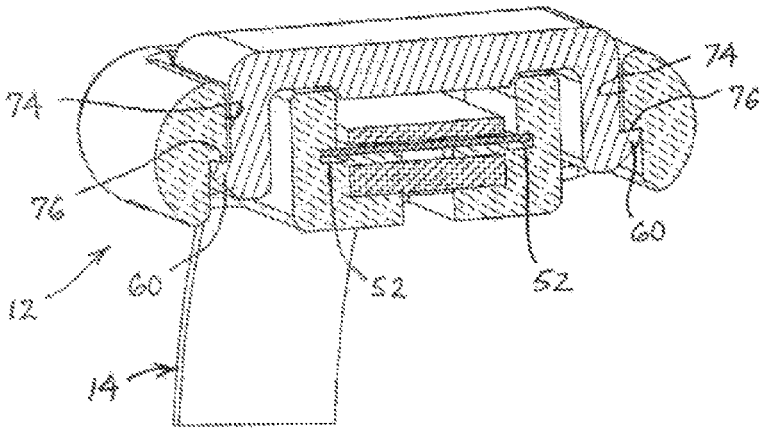
FIG. 8 is a perspective section view of the cable lacing tie device of FIG. 5 with the device being sectioned perpendicular to the lacing direction and with a simplified view of the cable lacing tape.
Figure 9:
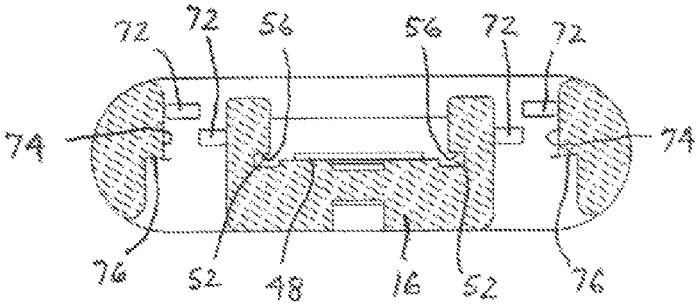
FIG. 9 is a section view of the body of the head assembly of the cable lacing tie device of FIG. 1 with the body being sectioned perpendicular to the lacing direction.
Figure 10:
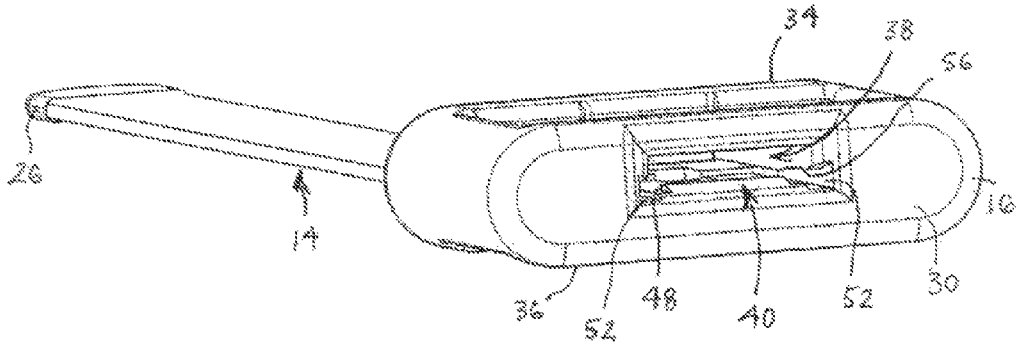
FIG. 10 is a perspective view of the cable lacing tie device of FIG. 1, without the compression member installed in the head assembly and with a simplified view of the cable lacing tape.

As best seen in FIGS. 7-9, the compression member 20 includes locking extensions 60 along its side walls 62, and detents 64 along a face of its front wall 66 and its rear wall 68. The compression member 20 also includes a downward extending rear engagement lug 70. The compression member 20 initially is disposed in a ready position in which it is held by the detents 64 on the compression member 20 being located between and engaging pairs of detents 72 within the body 16. This ready position holds the compression member 20 upward, so as not to block insertion of the cable lacing tape 14 through the entrance opening 40 in the rear surface 30 of the body 16. This allows for near zero insertion force of the cable lacing tape 14. Also, when in the ready position, the locking extensions 60 along the side walls 62 of the compression member 20 press against the vertical walls 74 within the body 16 and the side walls are deflected inward.

The cable lacing tie device 10 is easily and quickly installed. This is achieved by locating the head assembly 12 at or near a plurality of objects to be held together by the device. The second portion of the cable lacing tape 14 is then moved to a position looped around the plurality of objects, in a plane that is generally perpendicular to the longest axis of the objects, and the second portion of the cable lacing tape 14 is further moved to a position wherein it engages and is retained within the head assembly 12. In this first example, this is achieved by moving the distal or second end 28 with the tip 26 to the entrance opening 40 in the rear surface 30 of the body 16 of the head assembly 12. The tip 26 then is inserted into the entrance opening 40 and fed through the passageway 38 in the body 16 until the tip 26 extends outward and forward from the exit opening 42 in the front face 32 of the body 16. The tip 26 is then grasped and pulled until the cable lacing tape 14 has reached the desired level of tightness or tension. As the portion of the cable lacing tape 14 that is extending forward of the exit opening 42 is being pulled, a further more proximal length of the cable lacing tape 14 continues to pass through the passageway 38 and eventually the tension in the cable lacing tape 14 tends to pull the cable lacing tape 14 toward the center of the plurality of objects to be held together and therefore into more forceful engagement with the protrusions 24 extending from the retainer 18. At this point, the protrusions 24 tend to force filaments within the second portion of the braided cable lacing tape 14 to spread apart and permit the protrusions to extend between the filaments, with the retainer 18 urging a second portion of the cable lacing tape 14 into a retained position within the head assembly 12. In this example, the forward sloped angle of the protrusions 24 causes the braided filaments of the cable lacing tape 14 to become hooked on the protrusions 24. Once hooked on the protrusions 24, the protrusions 24 resist rearward movement of the second portion of the cable lacing tape 14. Thus, in the installed position, two portions of the cable lacing tape 14 are retained within the head assembly 12, with a first portion retained within the head assembly 12 in a first general direction and a second portion retained within the head assembly 12 in a second general direction, where the first and second general directions are substantially parallel.

As an added safety feature, this first example includes the compression member 20. With the cable lacing tape 14 pulled through the head assembly 12 until it has achieved the desired tension in the cable lacing tape 14, the compression member 20 then may be pressed downward. The compression member 20 is pressed until the detents 64 on the compression member 20 release from between the respective pairs of detents 72 within the body 16 of the head assembly 12. This moves the compression member 20 from its ready position and as it continues to be forced and moved toward the retainer 18, the rear engagement lug 70 presses on the cable lacing tape 14 to help ensure that the cable lacing tape 14 will remain engaged with the protrusions 24 on the retainer 18. When the locking extensions 60 on the side walls 62 of the compression member 20 reach the bottom of the vertical walls 74, the side walls 62 are permitted to expand outward to a rest position where the locking extensions 60 become located within the undercuts 76 that are located at the bottom of the vertical walls 74 of the body 16. As such, the compression member 20 has reached a locked position, further urging a second portion of the cable lacing tape 14 into a retained position within the head assembly 12 and ensuring that the cable lacing tape 14 cannot inadvertently lift away from the protrusions 24 on the retainer 18.

When in an installed, locked position, as seen in FIG. 5, the tip 26 and the distal end 28 may be tucked underneath the cable lacing tape 14 that extends around the objects being held together or bundled. Alternatively, to reduce bulk and unnecessary weight, the cable lacing tape 14 may be trimmed at the exit opening 42 or one may leave a portion extending a short distance from the exit opening 42 of the head assembly 12. Due to its braided filament structure, the reduced rigidity and relatively dull end of a trimmed cable lacing tape 14 help reduce potential abrasion among adjacent wires, wiring harnesses, cables or other objects, such as within bundling systems that are subject to movement or service activities. If one is concerned about the potential unraveling of a cut end of the cable lacing tape 14, then a suitable binding agent, such as an adhesive or glue may be used to join the separate filaments of the cut end.

Figure 12:
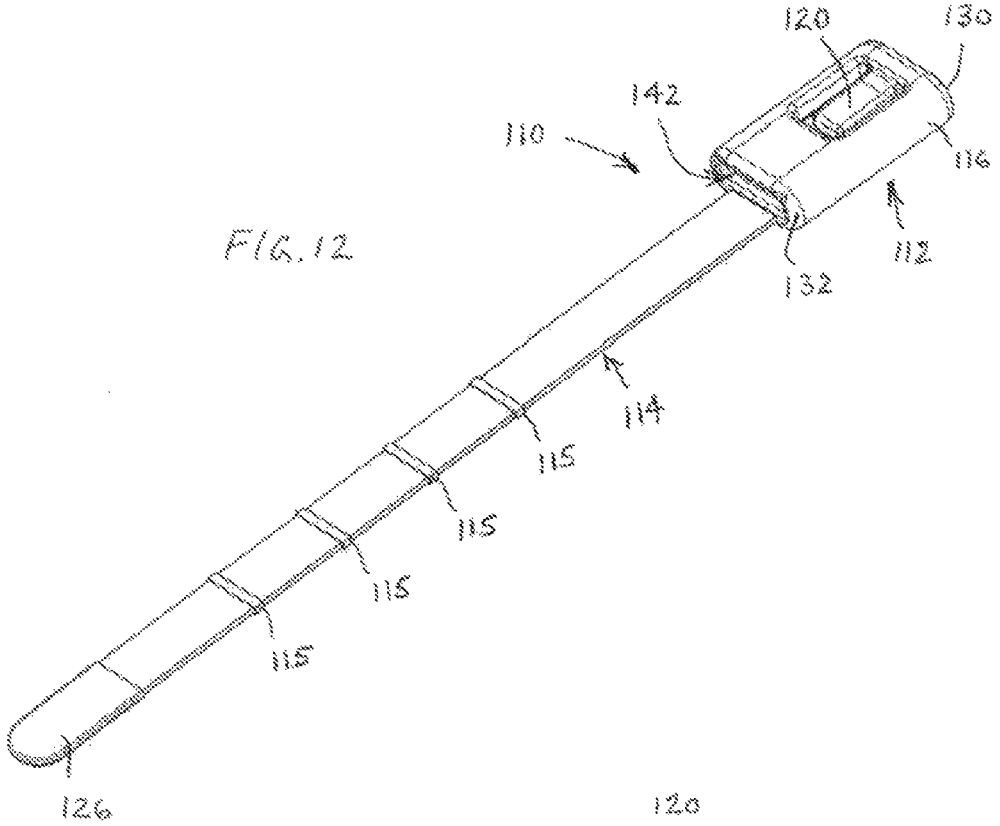
FIG. 12 is a perspective view of a second example cable lacing tie device in a pre-installed, ready position and with a simplified view of a cable lacing tape having segments.
Figure 13:
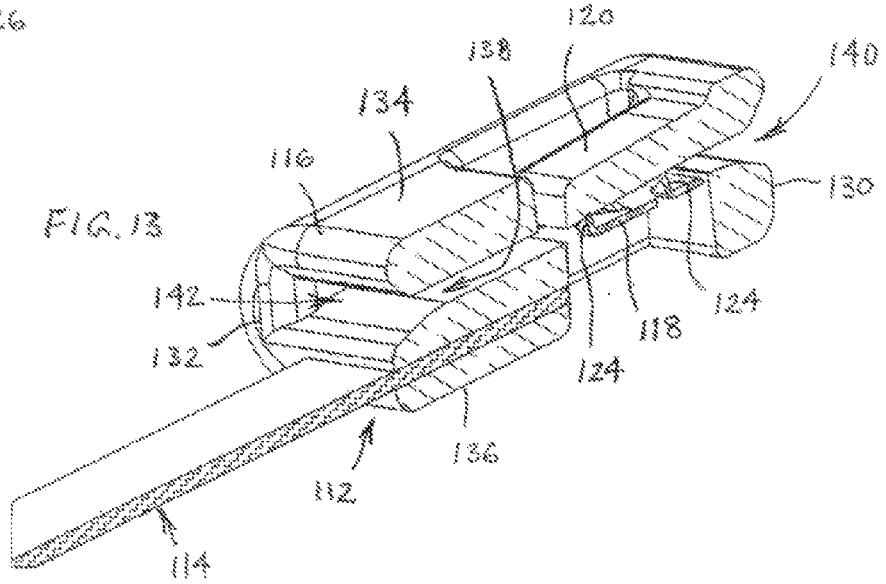
FIG. 13 is a perspective section view of the cable lacing tie device of FIG. 12 with the device being sectioned parallel to the lacing direction and with a simplified view of the cable lacing tape.

Among other variations from the first example cable lacing tie device 10, a second example cable lacing tie device 110, illustrated in FIGS. 12 and 13, includes a few alternative structures, such as a further alternative to avoiding unraveling of a cut end of an installed cable lacing tape 14 and an integrally molded compression member 120.

As shown in FIG. 12, the cable lacing tape 114 may include segments 115 at preselected positions along the length of the cable lacing tape 114, at positions that are thought to be preferable points at which to stop unraveling if the cable lacing tape 114 is cut. Such positions may be provided to permit removal of unnecessary or undesirable extra length of an installed cable lacing tape 114. The segments 115 may be molded to the cable lacing tape 114, or may be formed with other binding agents that are likely to prevent unraveling of the braided filaments of the cable lacing tape 114. The cable lacing tape 114 may be cut at any point along the portion of the cable lacing tape 114 that extends from the head assembly 112 that is more distal to at least a portion of such a segment 115. Thus, the cable lacing tape 114 is preferably cut at a point along its length that is located beyond a segment 115, so as to leave a soft end of the cable lacing tape 14 but with the assurance that it cannot unravel beyond the nearest segment 115. Alternatively, the cable lacing tape 114 could be cut through a segment 115, at a point that will leave a sufficient portion of the segment 115 to prevent the unraveling of the remaining cable lacing tape 114. It will be appreciated that such a cable lacing tape having segments may be used in any of the examples in this disclosure, and that the cable lacing tape 114 also would be of woven or braided construction but, for convenience, is illustrated in a simplified manner.

The second example cable lacing tie device 110 is otherwise constructed of similar materials and structures to that of cable lacing tie device 10, but instead of including the separate compression member 20, the device 110 includes an integrally formed compression member 120. Thus, the second example cable lacing tie device 110 includes a head assembly 112 and a length of cable lacing tape 114. The head assembly 112 includes a molded body 116, a retainer 118 shown in this example as a separate retainer plate, and an integrally formed alternative compression member 120. The head assembly 112 has a rear surface 130, a front surface 132, a top surface 134, a bottom surface 136, and a passageway 138 having an entrance opening 140 and an exit opening 142. The compression member 120 extends from the body 116. The retainer 118 is installed and held within the head assembly 112 in the same manner as described above with respect to the first example cable lacing tie device 10 by its interaction with surfaces within the body 116.

The protrusions 124 on the retainer 118 urge the second portion of the cable lacing tape 114 to be retained within the head assembly 116. In addition, in this example, the compression member 120 is biased to be disposed partially in the path of an incoming tip 126 at the second end of the cable lacing tape 114. Thus, the integrally formed compression member 120 tends to force the cable lacing tape 114 toward the retainer 118. This urges the second portion of the cable lacing tape 114 to be retained within the head assembly 112 by urging the cable lacing tape 114 to engage and be retained by the protrusions 124 on the retainer 118. Also, the tip 126 is a little longer than the tip 26 in the first example. This is intended to permit the tip 126 at the end of the cable lacing tape 114 to be inserted into the entrance opening 140 in the rear surface 130, through the passageway 138, and out the exit opening 142 in the front face 132 of the head assembly 112. The longer tip 126 is easier to grasp and manipulate as one moves it through the passageway 138 and deflects the integral compression member 120 in the body 116 of the head assembly 112 further away from the retainer 118. The tip 126 then may be grasped and pulled to advance the cable lacing tape 114 to a taught, installed position. Accordingly, this second example cable lacing tie device 110 may be installed using a similar method of holding together a plurality of objects. When in the installed position it will be appreciated that two portions of the cable lacing tape 114 are retained within the head assembly 112, with a first portion retained within the head assembly 112 in a first general direction and a second portion retained within the head assembly 112 in a second general direction, where the first and second general directions are substantially parallel.

Figure 14:
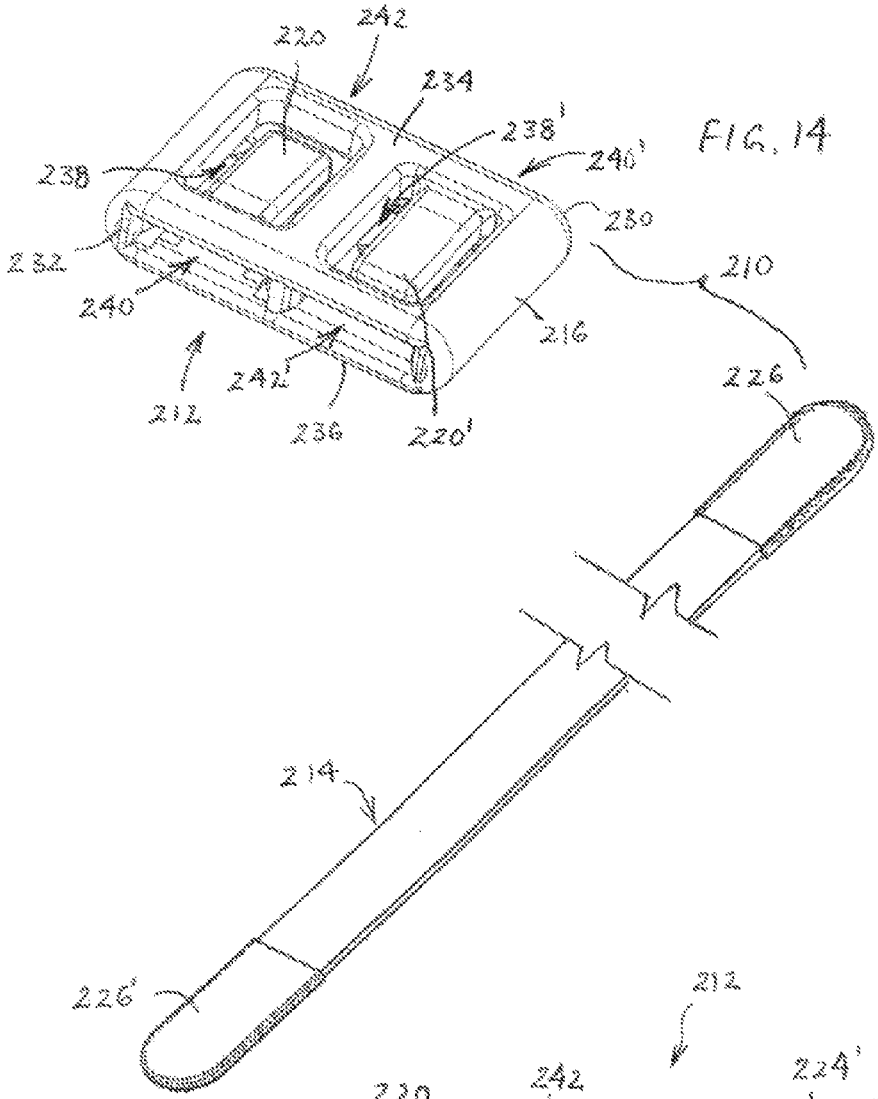
FIG. 14 is a perspective view of a head assembly and a cable lacing tape in a third example cable lacing tie device.
Figure 15:
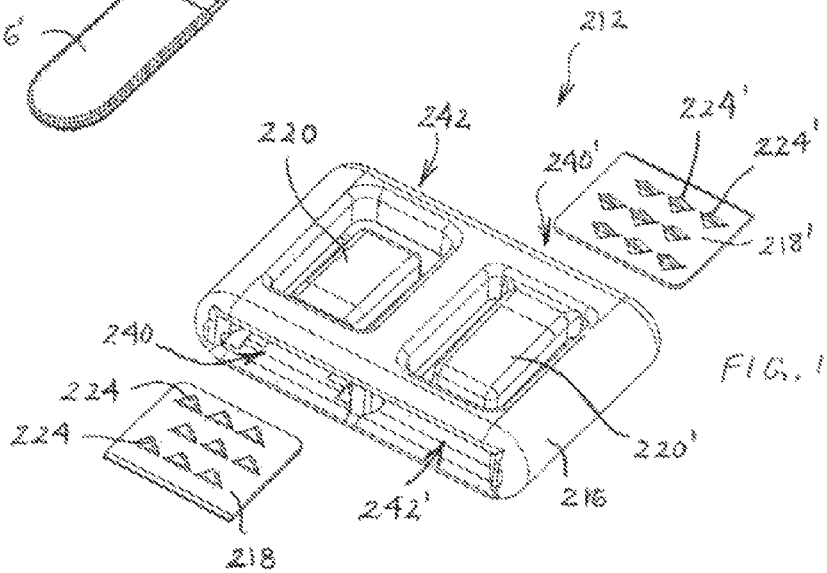
FIG. 15 is a perspective exploded view of the head assembly of FIG. 14.

Turning to FIGS. 14 and 15, a third example cable lacing tie device 210 is illustrated. This example device 210 includes a head assembly 212 that has a structure that resembles a joined pair of oppositely facing head assemblies 112 of the second example device 110, but the cable lacing tape 214 is not fixedly connected to the head assembly 212 by being insert-molded within the body 216. To be able to feed the respective ends of the length of cable lacing tape 214 through the passageways 238, 238', the cable lacing tape 214 has a tip, such as tips 226, 226' described above as being formed by insert-molding, at each end of the length of cable lacing tape 214. The head assembly 212 may be constructed of similar materials and via similar techniques to those described with respect to the prior example devices 10 and 110. The cable lacing tape 214 may be constructed similarly to either of the cable lacing tapes 14 and 114 of the prior examples, but is shown, for convenience, in a simplified manner.

The head assembly 212 includes a body 216 having a rear surface 230, a front surface 232, a top surface 234, a bottom surface 236, and passageways 238, 238' having respective entrance openings 240, 240' and exit openings 242, 242'. The head assembly 212 also includes integrally molded compression members 220, 220' that tend to force an inserted cable lacing tape 214 toward respective retainers 218, 218', in the form of respective retainer plates, with each being installed and held within the head assembly 212 in the same manner as described with respect to the first and second example cable lacing tie devices 10, 110. The retainers 218, 218' are configured as described in relation to the previous examples and have protrusions 224, 224', which act to urge the cable lacing tape 214 to be retained within the head assembly 212.

The head assembly 212 is used in a manner similar to the previous examples, however, as noted above, the cable lacing tape 214 is not molded within the head assembly 212. Instead, a first portion of the cable lacing tape 214 is retained in a first position within the head assembly 212 by inserting the first end with tip 226 through one of the passageways, such as passageway 238, to secure a first portion within the head assembly 212. Then, the head assembly 212 and cable lacing tape 214 may be treated in a manner similar to the previous examples to hold together a plurality of objects by locating the head assembly at or near the plurality of objects, moving a second portion of the cable lacing tape 214 to a position looped around the plurality of objects, and then moving the second portion of the cable lacing tape 214 to a position wherein the second portion of the cable lacing tape engages and is retained within the head assembly 212. This is accomplished by inserting the tip 226' at the second end of the cable lacing tape through the second passageway 238'. Either or both of the ends of the cable lacing tape 214 then may be pulled to tighten the cable lacing tie device 210 around the plurality of objects. Thus, when installed, first and second portions of the cable lacing tape 214 are retained within the head assembly 212, with a first portion retained in a first general direction and a second portion retained within the head assembly 212 in a second general direction, where the first and second general directions are substantially parallel. Also, optionally, any excess length of cable lacing tape extending from the respective exit openings 242, 242' may be removed by cutting the cable lacing tape 214, if desired.

It is contemplated that the tip 226 on a first end of the cable lacing tape 214 may be inserted into the entrance opening 240 and moved through the passageway 238 only as far as is necessary to have the tip 226 on the first end of the cable lacing tape extend from the exit opening 242. Using this method, any cutting along the length of a preformed cable lacing tape having a tip at each end could be confined to an optional single cut to remove any excess cable lacing tape from the second end after it is inserted and moved through the passageway 238' and extends from the exit opening 242'. Also, with the third example cable lacing tie device 210, any of the aforementioned structures and methods of controlling potential unraveling of the braided filament cable lacing tape 214 may be employed, if desired.

A fourth example cable lacing tie device 310 is illustrated in FIGS. 16 and 17. The cable lacing tie device 310 includes a head assembly 312 and a cable lacing tape 314 that is configured to have a first portion 322 retained in a first position within the head assembly 312 by having a first end insert-molded to a body 316 of the head assembly 312. The body 316 has a rear surface 330, a front surface 332, a top surface 334, a bottom surface 336, and a passageway 338 having an entrance opening 340 and an exit opening 342. The passageway 338 through the body 316 includes a retainer 318 shown in this example in the form of an integral retainer formed along a surface within the body 316, although it will be appreciated that a separate inserted retainer may be utilized. In this example, the integral retainer 318 includes upstanding protrusions 324 and the cable lacing tie device 310 does not include a compression member. The protrusions 324 permit the retainer 318 to urge the second portion of the cable lacing tape 314 to engage and be retained in the head assembly 312. The head assembly 312 also may be constructed using similar materials and techniques to those described with respect to the prior examples. While the cable lacing tape 314 may be constructed similarly to the prior examples, it is shown without an insert-molded tip at the distal or second end 328, as the tip is optional.

The cable lacing tie device 310 is easily and quickly installed. This is achieved by having a first portion 322 of the cable lacing tape 314 retained within the head assembly 312 and by locating the head assembly 312 at or near a plurality of objects to be held together by the device 310. The second portion of the cable lacing tape 314 that extends from the head assembly 312 then is moved to a position looped around the plurality of objects, in a plane that is generally perpendicular to the longest axis of the objects, and the second portion of the cable lacing tape 314 is moved to a position wherein the second portion is retained within the head assembly 312. This is achieved by moving the distal or second end 328 to the entrance opening 340 in the rear surface 330 of the body 316 of the head assembly 312, inserting the second end 328 into the entrance opening 340 and feeding the second end 328 through the passageway 338 in the body 316 until the second end 328 extends outward from the exit opening 342 in the front face 332 of the body 316. While the cable lacing tape 314 should be able to pass through the passageway 338 without difficulty even without a tip at the second end 328, if the cable lacing tape 314 is not sufficiently stiff, then when inserting the second end 328 into the entrance opening 340, it may be necessary to loop the cable lacing tape 314 upward, out of the passageway 338. As the second end 328 begins to extend over the protrusions 324 on the retainer 318, an ease of grasping the second end 328 and directing it up and over the protrusions 324 may be provided with an opening 343 in the top surface 334. The second end 328 of the cable lacing tape 314 then may be directed back downward into the passageway 338 and through the exit opening 342.

Once the second end 328 is extending out from the exit opening 342, it then may be grasped and pulled. As the portion of the cable lacing tape 314 that is extending from the exit opening 342 is being pulled, a further more proximal portion of the cable lacing tape 314 continues to pass through the passageway 338 and eventually the tension in the cable lacing tape 314 tends to pull the cable lacing tape 314 toward the center of the group of the plurality of objects to be held together and into engagement with the protrusions 324 extending from the retainer plate 318, until the cable lacing tape 314 has reached the desired level of tightness or tension. At this point, the protrusions 324 tend to force filaments to spread apart and permit the protrusions 324 to extend between filaments within the braided cable lacing tape 314. The upright protrusions 324 in this example cause the braided filaments of the cable lacing tape 314 to become hooked on the protrusions 324. Once hooked on the protrusions 324, the protrusions 324 resist rearward movement of the cable lacing tape 314. Accordingly, when installed, first and second portions of the cable lacing tape 314 are retained within the head assembly 312, with a first portion retained in a first general direction and a second portion retained within the head assembly 312 in a second general direction, where the first and second general directions are substantially parallel.

When in this installed, locked position, the free second end 328 may be tucked underneath the cable lacing tape 314 that extends around the objects being bundled, as could be done with any of the other examples disclosed herein. Alternatively, to reduce bulk and unnecessary weight, the cable lacing tape 314 may be trimmed at the exit opening 342 or so as to leave a portion extending a short distance from the exit opening 342 of the head assembly 312. Due to its braided filament structure, the reduced rigidity and relatively dull end of a trimmed cable lacing tape 314 helps reduce potential abrasion among adjacent wires, wiring harnesses, cables or other objects within systems, such as bundling systems that are subject to movement or service activities. If one is concerned about potential unraveling of the cable lacing tape 314, then any of the previously discussed structures and methods may be employed.

As an added safety feature, this method of installation may include application of a binding agent, such as a glue or adhesive, within the opening 343 in the top surface 334 of the body 316. Application of a binding agent to the cable lacing tape 314, in this location, can serve to prevent unraveling of the braided filaments of the cable lacing tape 314 if a length of the cable lacing tape 314 is removed from where it extends outward from the exit opening 342, and may serve to bind the cable lacing tape 314 to the integrally formed retainer 318. Thus, with the cable lacing tape 314 pulled through the head assembly 312 until it has achieved the desired tension in the cable lacing tape 314, the protrusions 324 will prevent the rearward movement and withdrawal of the cable lacing tape 314, thereby urging the second portion of the cable lacing tape 314 to be retained within the head assembly 312. If applying a binding agent to the cable lacing tape 314 within the opening 343, it is preferable to do so prior to optionally cutting away any excess length of cable lacing tape 314 that extends from the exit opening 342.

Figure 18:
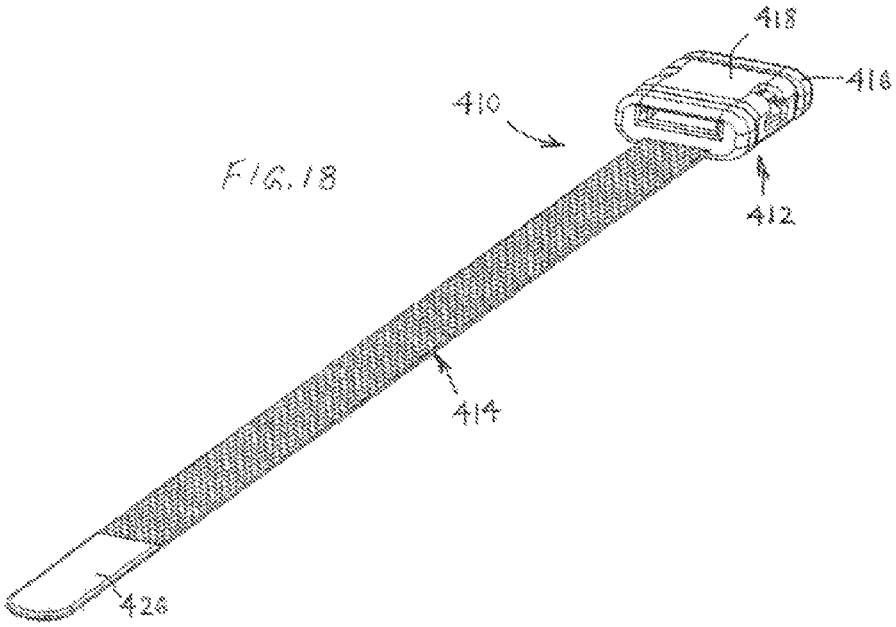
FIG. 18 is a perspective view of a fifth example cable lacing tie device having a retainer in a locked position.
Figure 19:
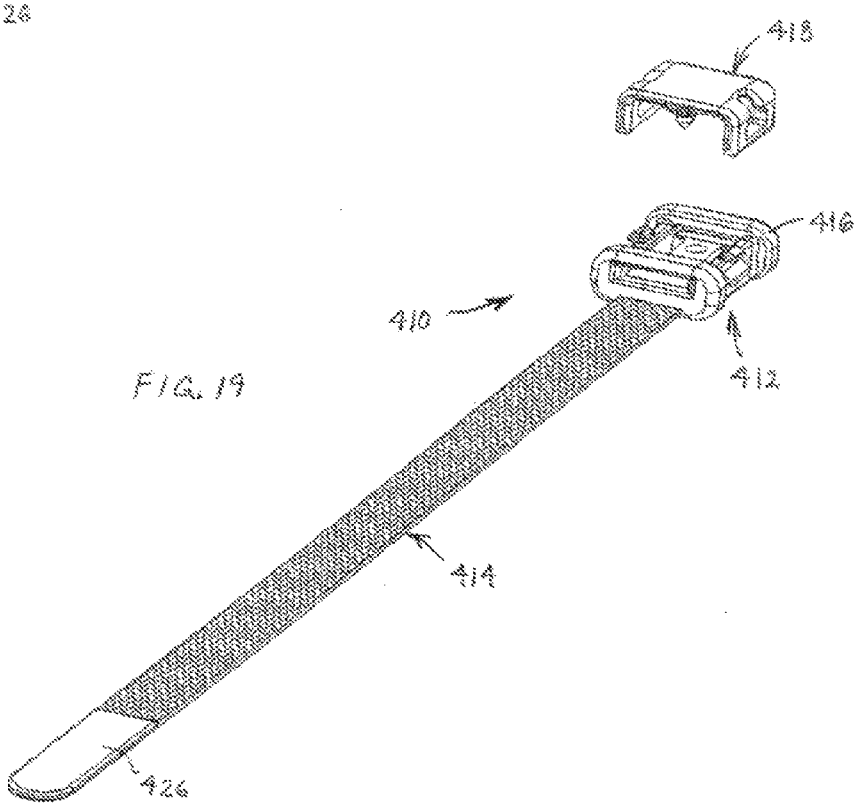
FIG. 19 is a perspective partially exploded view of the cable lacing tie device of FIG. 18.
Figure 20:
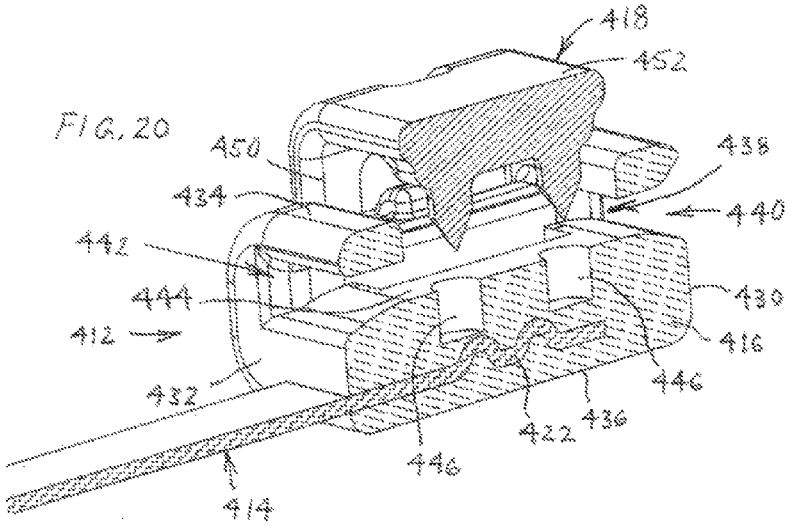
FIG. 20 is a perspective section view of the cable lacing tie device of FIG. 18 having the retainer in an unlocked, ready position, with the device being sectioned parallel to the lacing direction and with a simplified view of the cable lacing tape.
Figure 21:
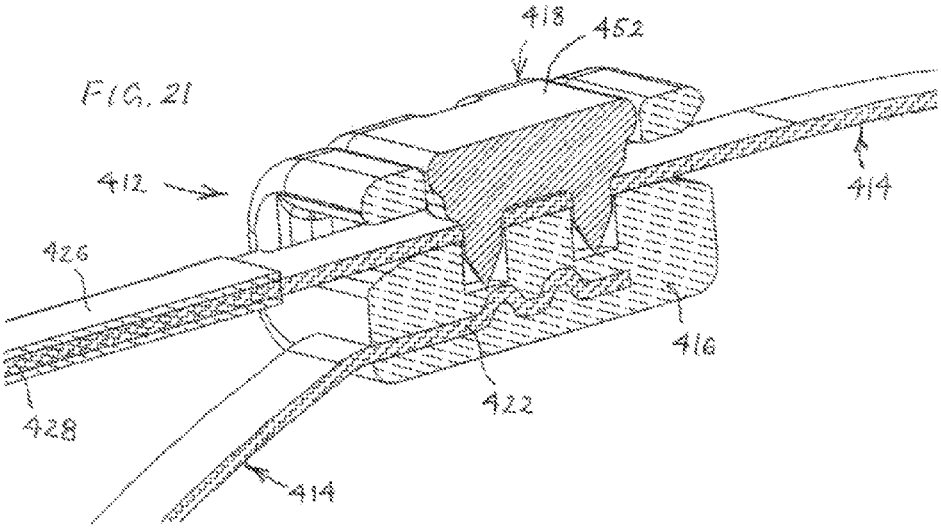
FIG. 21 is a perspective section view of the cable lacing tie device of FIG. 18 having the retainer in a locked position, with the device being sectioned parallel to the lacing direction and with a simplified view of the cable lacing tape.
Figure 22:
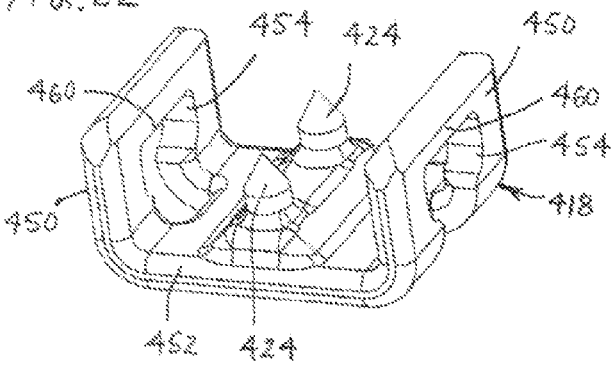
FIG. 22 is a perspective view of the retainer of the cable lacing tie device of FIG. 18 in an inverted position.
Figure 23:
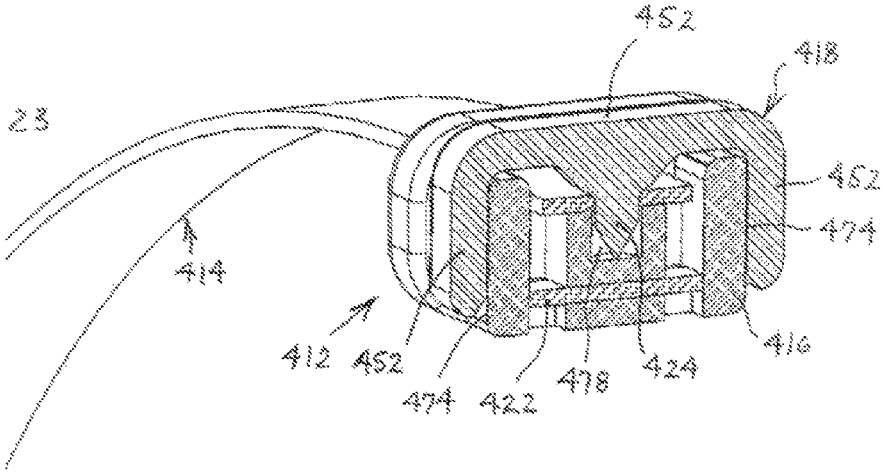
FIG. 23 is a perspective section view of the cable lacing tie device of FIG. 18 having the retainer in a locked position, with the device being sectioned through a protrusion on the retainer and perpendicular to the lacing direction and with a simplified view of the cable lacing tape.

Turning to FIGS. 18-24, a fifth example cable lacing tie device 410 is illustrated. The cable lacing tie device 410 includes a head assembly 412 and a length of cable lacing tape 414 that may be constructed using similar materials and techniques to those described in the prior examples. The head assembly 412 of this example includes a molded body 416 and a retainer 418 in the form of a generally U-shaped cap. A first portion 422 of the cable lacing tape 414 is configured to be retained in a first position within the head assembly 412 by having a first end insert-molded within the body 416 in a tortuous path for enhanced retention, as best seen in FIGS. 20 and 21. As with the prior examples, a tip 426 is molded to the distal or second end 428 of the cable lacing tape 414 that extends from the head assembly 412, as best seen in FIGS. 18 and 21. As with the prior examples, the cable lacing tie device 410 may be used, for example, to hold together a plurality of objects, such as to form or contain a bundle of wires, wire harnesses, cables or other objects.

As best seen in FIG. 20, the body 416 of the head assembly 412 has a rear surface 430, a front surface 432, a top surface 434, a bottom surface 436, and a passageway 438 having an entrance opening 440 and an exit opening 442. The passageway 438 through the body 416 includes a lower surface 444, and a pair of recesses 446 that receive the protrusions 424 of the retainer 418. The recesses 446 provide additional support for the protrusions 424 against the force that may be imparted by tension in the cable lacing tape 414.

The retainer 418, in this example shown in the form of a U-shaped cap, may be molded of similar materials and by similar techniques to those used to form the body 416 to which the retainer 418 is connected. The retainer 418 includes a pair of side walls 450 connected by an upper portion 452. The side walls 450 include openings 454, which form locking extensions 460 that extend in the direction of the cable lacing tape 414 along the lower end of the side walls 450. The body 416 of the head assembly 412 includes a narrowed central portion having spaced vertical walls 474. The side walls 450 of the retainer 418 are positioned to cooperated with and slide along the spaced vertical walls 474 of the narrowed central portion of the body 416.

The vertical walls 474 have first ramped extensions 465 that provide undercuts 466 located at the top of the vertical walls 474 of the body 416, and second ramped extensions 475 that provide undercuts 476 located along the middle of vertical walls 474 of the body 416. The ramped extensions 465, 475 are configured to cause the side walls 450 of the retainer 418 to be forced outward as the retainer 418 is moved by a user, such as when pressing the retainer 418 toward the body 416. The side walls 450 and their respective locking extensions 460 slide along the vertical walls 474, such that the retainer 418 can cooperate with the ramped extensions 465, 475. Thus, to install the retainer 418 in a ready position, such as is shown in FIG. 20, the retainer 418 may be moved to have the locking extensions 460 engage and ride over the first ramped extensions 465, thereby coming to rest between the first and second ramped extensions 465, 475, and against the undercuts 466. The cable lacing tie device 410 could be manufactured and distributed in such a ready position.

Figure 24:
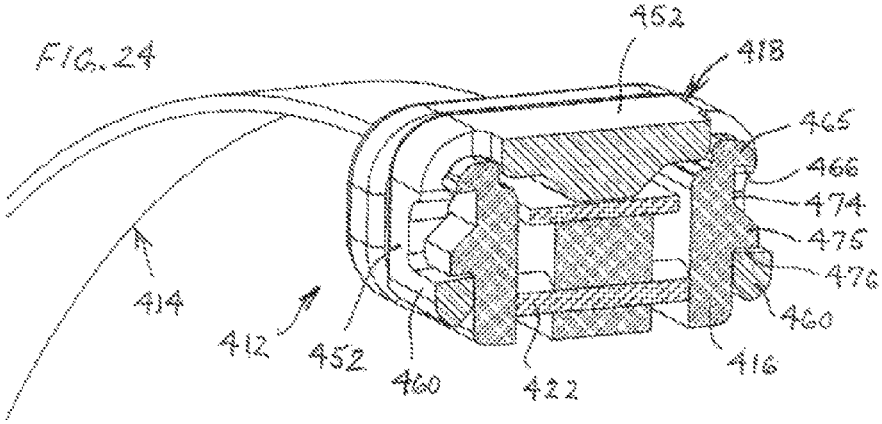
FIG. 24 is a perspective section view of the retainer of the cable lacing tie device of FIG. 18 having the retainer in a locked position, with the device being sectioned through the retainer and perpendicular to the lacing direction, and with a simplified view of the cable lacing tape.

The cable lacing tie device 410 may be installed using the same steps as were described with the prior examples. Thus, when installing a cable lacing tie device 410, once a second portion of a cable lacing tape 414 is looped around a plurality of objects to be held together and is passed through the passage 438 in the body 416 of the head assembly 412, the retainer 418 may be moved to a locked position to urge the second portion of the cable lacing tape to engage and be retained within the head assembly 412, as best seen in FIG. 21. It will be appreciated that when the retainer 418 is moved toward the locked position, the ramped extensions 475 cause the side walls 450 of the retainer 418 to be forced outward as the retainer 418, until the locking extensions 460 ride over the ramped extensions 475 and reach a locked position with the locking extensions 460 coming to rest against the undercuts 476, as best seen in FIG. 24.

To retain the second portion of the cable lacing tape 414 in the head assembly, the retainer 418 also has a pair of protrusions 424 extending from the underside of the upper portion 452. The retainer protrusions 424 are configured to engage the second portion of the cable lacing tape 414 that is moved to a position extending through the head assembly 412. As with the protrusions of the prior examples, when the retainer 418 is moved to a locked position, the protrusions 424 tend to force filaments within the second portion of the braided cable lacing tape 414 to spread apart and permit the protrusions to extend between the filaments. The protrusions 424 cause the braided filaments of the cable lacing tape 414 to become hooked on the protrusions 424. Once hooked on the protrusions 424, the protrusions 424 resist rearward movement of the second portion of the cable lacing tape 414. Thus, in the installed and locked position, two portions of the cable lacing tape 414 are retained within the head assembly 412, with a first portion retained within the head assembly 412 in a first general direction and a second portion retained within the head assembly 412 in a second general direction, where the first and second general directions are substantially parallel. The excess cable lacing tape 414 extending from the head assembly 412 may be cut away, if desired, and unraveling may be prevented by use of any of the previously described structures and methods.

Figure 27:
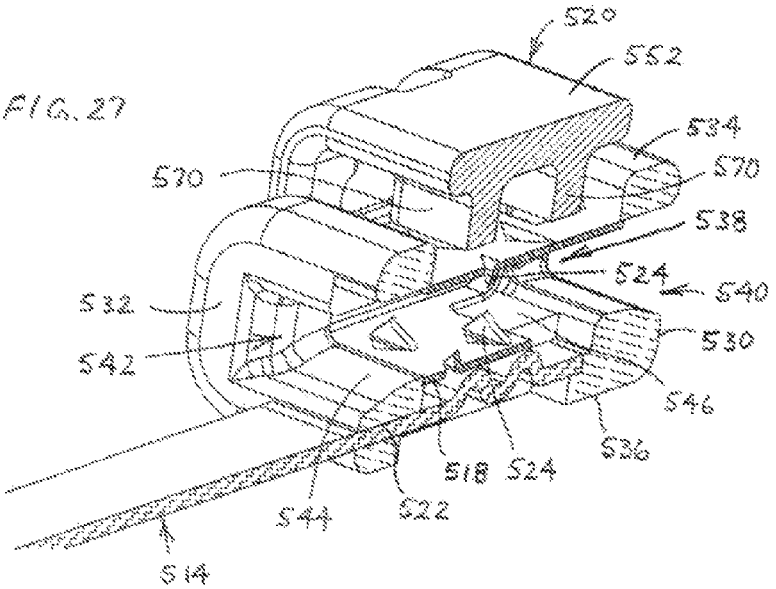
FIG. 27 is a perspective section view of the cable lacing tie device of FIG. 25 having the compression member in an unlocked, ready position, with the device being sectioned parallel to the lacing direction and with a simplified view of the cable lacing tape.
Figure 28:
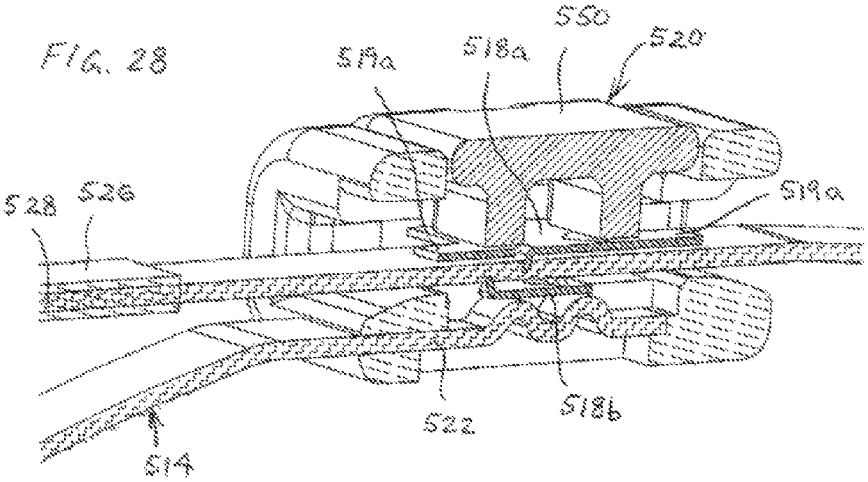
FIG. 28 is a perspective section view of the cable lacing tie device of FIG. 25 having the compression member in a locked position, with the device being sectioned parallel to the lacing direction and with a simplified view of the cable lacing tape.
Figure 29:
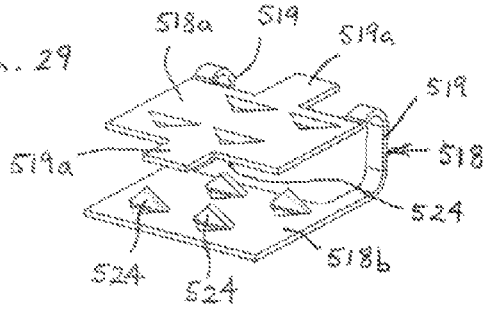
FIG. 29 is a perspective view of a retainer that is a component of the head assembly of the cable lacing tie device of FIG. 25.
Figure 30:
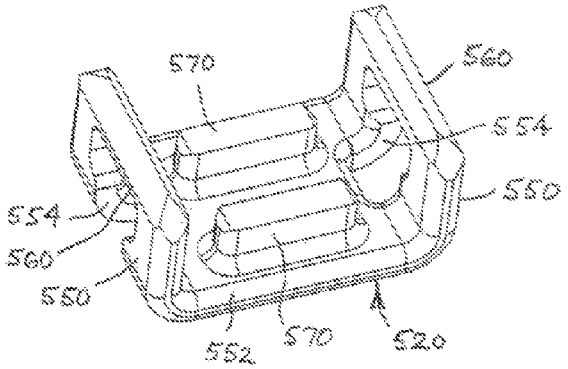
FIG. 30 is a perspective view of the compression member of the cable lacing tie device of FIG. 25 in an inverted position.

A sixth example cable lacing tie device 510 is illustrated in FIGS. 25-31. The cable lacing tie device 510 includes a head assembly 512 and a length of cable lacing tape 414 that may be constructed using similar materials and techniques to those described in the prior examples. The head assembly 512 of this example includes a molded body 516 and a retainer 518. As best seen in FIG. 29, the retainer 518 has a generally U-shaped structure that effectively provides upper and lower retainer plates 518*a* and 518*b*, that are structurally similar to the retainer 18 of the first example cable lacing tie device 10. Thus, each of the retainer plates 518*a*, 518*b* includes protrusions 524 that are formed, such as by stamping, to be forward sloped, so as to be able to separate and move between and hook the braided filaments of the cable lacing tape 514 and to resist rearward movement of the cable lacing tape 514, thereby urging a second portion of the cable lacing tape 514 to be retained within the head assembly 512.

Figure 25:
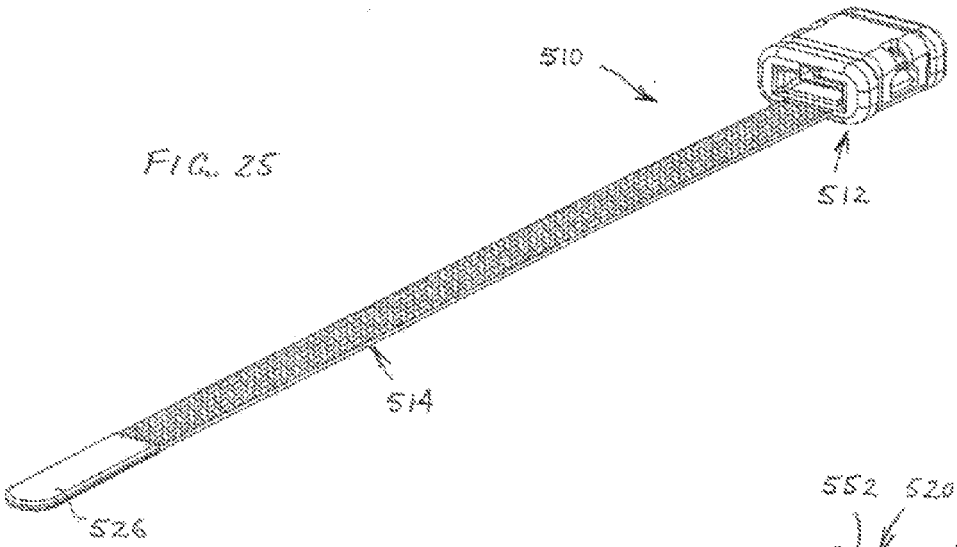
FIG. 25 is a perspective view of a sixth example cable lacing tie device having a compression member in a locked position.
Figure 26:
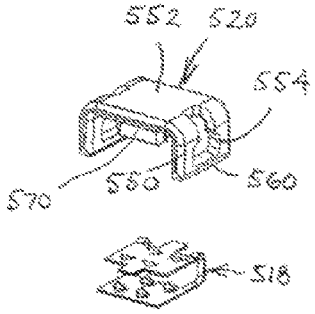
FIG. 26 is a perspective partially exploded view of the cable lacing tie device of FIG. 25.
Figure 26:
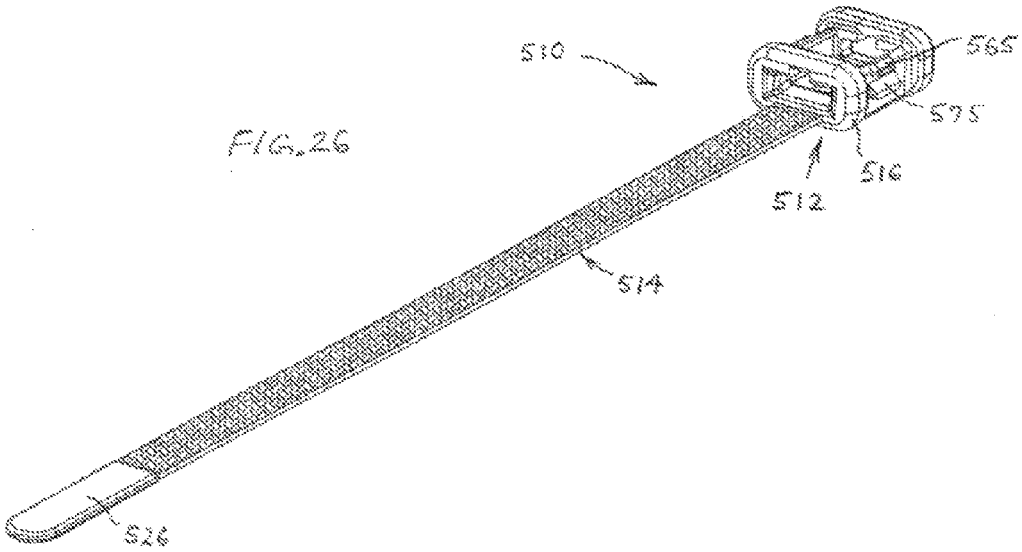

A first portion 522 of the cable lacing tape 514 is configured to be retained in a first position within the head assembly 512 by having a first end insert-molded within the body 516 in a tortuous path for enhanced retention, as best seen in FIGS. 27 and 28. A length of the cable lacing tape 514 then extends from the front of the head assembly 512. As with the prior examples, a tip 526 is molded to the distal or second end 528 of the cable lacing tape 514 that extends from the head assembly 512, as best seen in FIGS. 25 and 28. Similarly to the prior examples, the cable lacing tie device 510 may be used, for example, to hold together a plurality of objects, such as to form or contain a bundle of wires, wire harnesses, cables or other objects.

As best seen in FIG. 27, the body 516 of the head assembly 512 has a rear surface 530, a front surface 532, a top surface 534, a bottom surface 536, and a passageway 538 having an entrance opening 540 and an exit opening 542. The passageway 538 through the body 516 includes a lower surface 544 and a recess 546 that receives the lower retainer plate 518*b* of the retainer 518. The recess 546 has a front wall 548 that engages a front edge of the lower retainer plate 518*b*. The retainer 518 includes vertical strips 519 that connect the upper and lower retainer plates 518*a*, 518*b* and that engage inner surfaces of a rear wall within the body 516 of the head assembly 512. The upper retainer plate 518*a* also includes extensions 519*a* that engage inner surfaces of an upper wall within the body 516. These engagement surfaces serve to locate the retainer 518 when the retainer 518 is installed in the body 516 of the head assembly 512 by inserting it through the exit opening 542 and allowing the resilience of the retainer 518 to hold itself in place. The retainer 518 may be constructed of the same materials and by similar techniques to those used for the retainer 18 of the first example.

The head assembly 512 of this example includes a compression member 520. The compression member 520 is constructed somewhat similarly to the retainer 418, in that it is in the form of a U-shaped cap and may be molded of similar materials and by similar techniques to those used to form the body 516 to which the compression member 520 is connected. The compression member 520 includes a pair of side walls 550 connected by an upper portion 552. The side walls 550 include openings 554, which form locking extensions 560 that extend in the direction of the cable lacing tape 514 along the lower end of the side walls 550. The compression member 520 also includes a pair of downward extending engagement lugs 570 that are positioned for engagement with the upper retainer plate 518*a* of the retainer 518. The body 516 of the head assembly 512 includes a narrowed central portion having spaced vertical walls 574, somewhat like the spaced vertical walls 474 of the body 416. The side walls 550 of the compression member 520 are positioned to cooperate with and slide along the spaced vertical walls 574 of the narrowed central portion of the body 516.

The vertical walls 574 have first ramped extensions 565 that provide undercuts 566 located at the top of the vertical walls 574 of the body 516, and second ramped extensions 575 that provide undercuts 576 located along the middle of vertical walls 574 of the body 516. The ramped extensions 565, 575 are configured to cause the side walls 550 of the compression member 520 to be forced outward as the compression member 520 is moved by a user, such as when pressing the compression member 520 toward the body 516. The side walls 550 and their respective locking extensions 560 slide along the vertical walls 574, such that the compression member 520 can cooperate with the ramped extensions 565, 575. To install the compression member 520 in a ready position, such as is shown in FIG. 27, the compression member 520 may be moved to have the locking extensions 560 engage and ride over the first ramped extensions 565, thereby coming to rest between the first and second ramped extensions 565, 575, and against the undercuts 566. The cable lacing tie device 510 could be manufactured and distributed in such a ready position.

Figure 31:
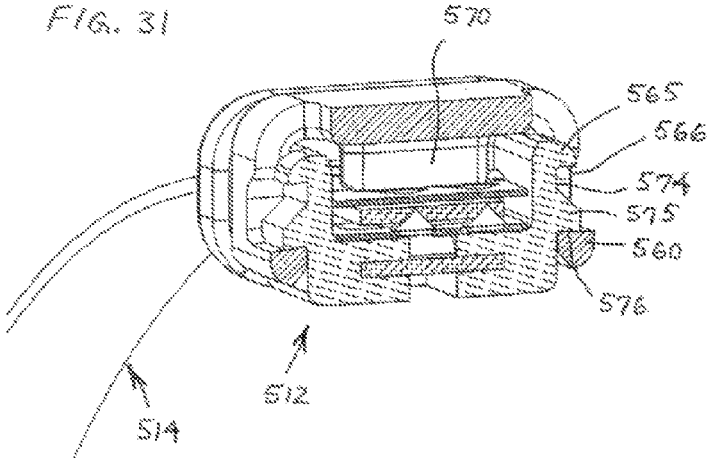
FIG. 31 is a perspective section view of the cable lacing tie device of FIG. 25 having the compression member in a locked position, with the device being sectioned through the compression member and perpendicular to the lacing direction, and with a simplified view of the cable lacing tape.
Figure 32:
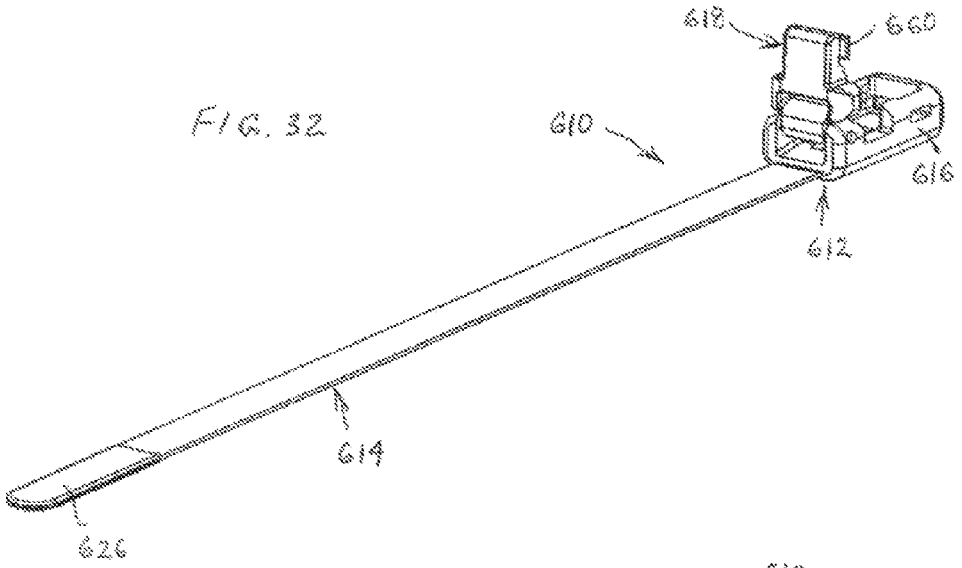
FIG. 32 is a perspective view of a seventh example cable lacing tie device having a compression member in an unlocked, ready position and with a simplified view of the cable lacing tape.
Figure 33:
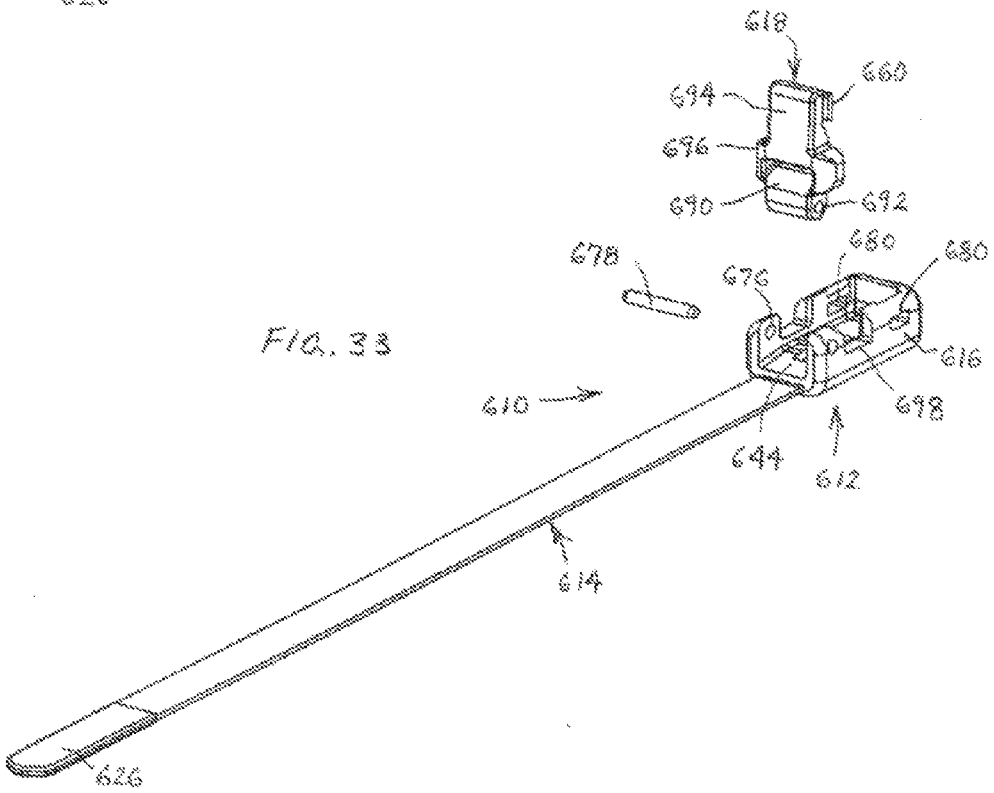
FIG. 33 is a perspective partially exploded view of the cable lacing tie device of FIG. 32.

With the compression member 520 in the ready position, the cable lacing tie device 510 may be installed using the same steps as were described with the prior examples. Thus, when installing a cable lacing tie device 510, once a second portion of a cable lacing tape 514 is looped around a plurality of objects to be held together and is passed through the passage 538 in the body 516 of the head assembly 512, the compression member 520 may be moved to a locked position, such as shown in FIG. 28, in which the engagement lugs 570 engage the upper retainer plate 518*a* of the retainer 518 and force the upper retainer plate 518*a* toward the lower retainer plate 518*b*, so as to urge the second portion of the cable lacing tape 614 to engage and be retained within the head assembly 512. It will be appreciated that when the compression member 520 is moved toward the locked position, the ramped extensions 575 cause the side walls 550 of the compression member 520 to be forced outward until the locking extensions 560 ride over the ramped extensions 575 and reach a locked position with the locking extensions 560 coming to rest against the undercuts 576, as best seen in FIG. 31. Thus, in the installed and locked position, two portions of the cable lacing tape 514 are retained within the head assembly 512, with a first portion retained within the head assembly 512 in a first general direction and a second portion retained within the head assembly 512 in a second general direction, where the first and second general directions are substantially parallel. As with the prior examples, the excess cable lacing tape 514 extending from the head assembly 512 may be removed and, if desired, unraveling may be prevented by employing any of the previously described structures or methods.

Figure 36:
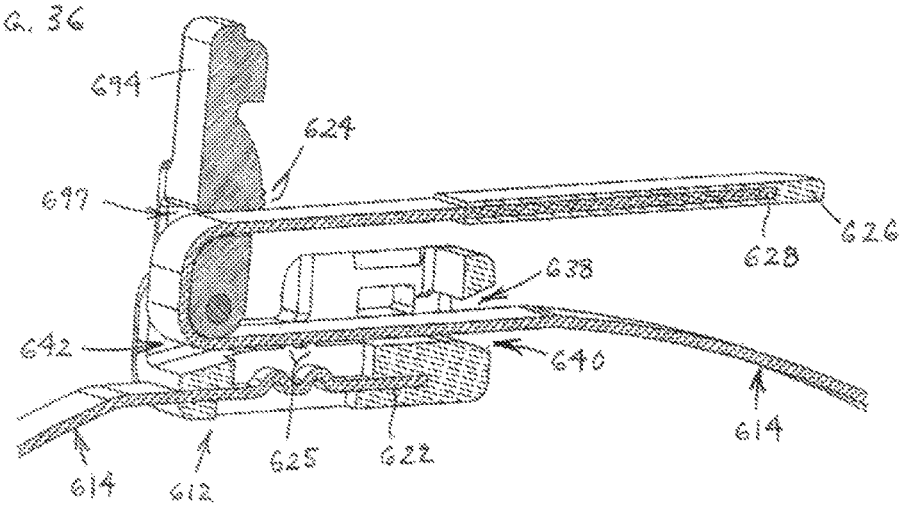
FIG. 36 is a perspective section view of the cable lacing tie device of FIG. 32 having the compression member in an unlocked, ready position and the cable lacing tape being passed through the head assembly and around the compression member, with the device being sectioned parallel to the lacing direction and with a simplified view of the cable lacing tape.
Figure 37:
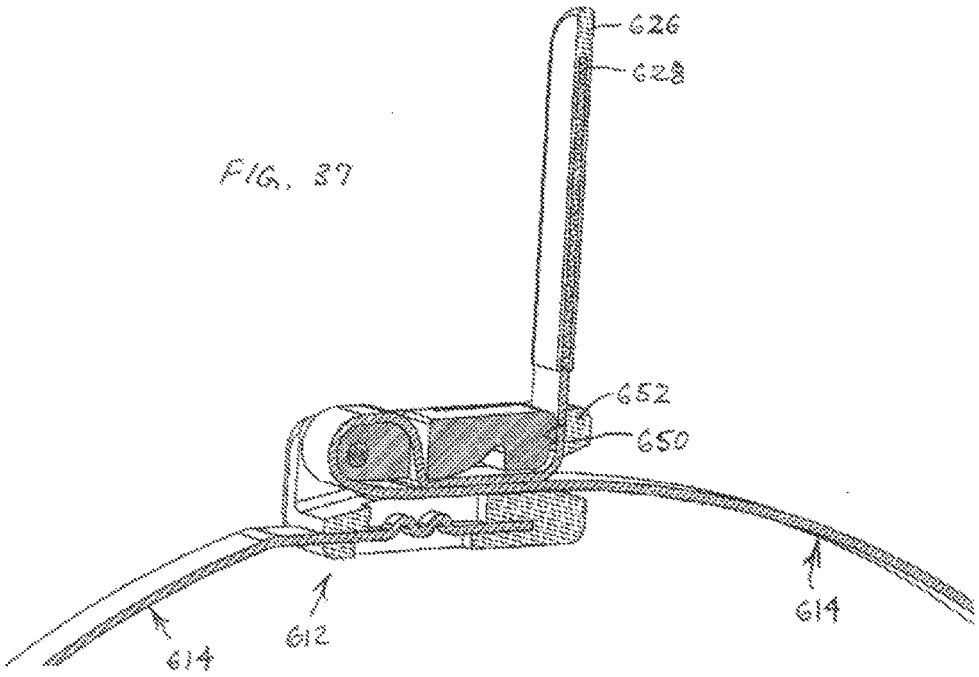
FIG. 37 is a perspective section view of the cable lacing tie device of FIG. 32 having the compression member in a locked position and the cable lacing tape being passed through the head assembly and around the compression member, with the device being sectioned parallel to the lacing direction and with a simplified view of the cable lacing tape.
Figure 38:
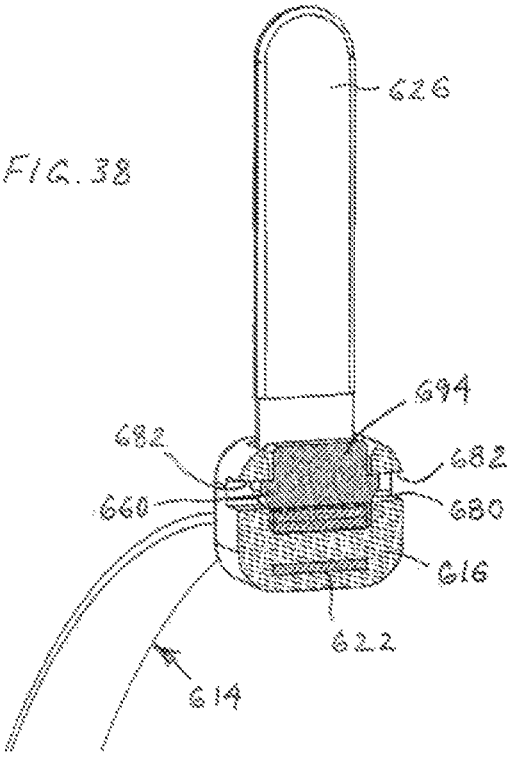
FIG. 38 is a perspective section view of the cable lacing tie device of FIG. 32 having the compression member in a locked position, with the device being sectioned through the compression member at a latch and perpendicular to the lacing direction, and with a simplified view of the cable lacing tape.
Figure 39:
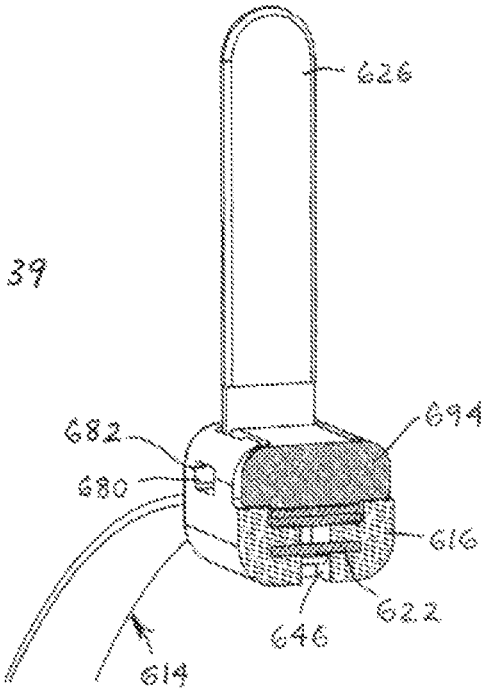
FIG. 39 is a perspective section view of the cable lacing tie device of FIG. 32 having the compression member in a locked position, with the device being sectioned through the compression member and perpendicular to the lacing direction, and with a simplified view of the cable lacing tape.
Figure 40:
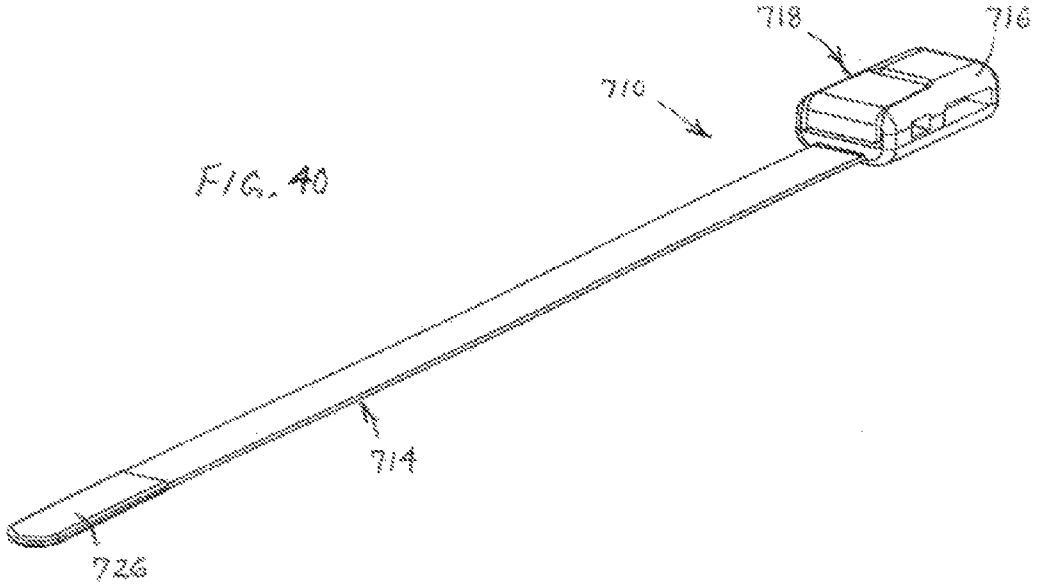
FIG. 40 is a perspective view of an eighth example cable lacing tie device having a compression member in a locked position and with a simplified view of the cable lacing tape.
Figure 41:
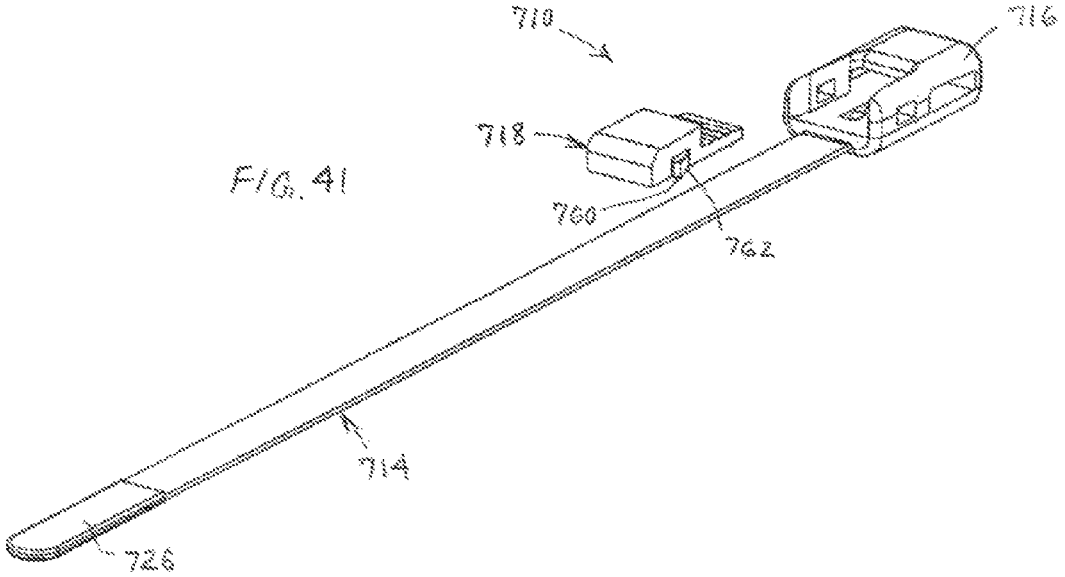
FIG. 41 is a perspective partially exploded view of the cable lacing tie device of FIG. 40.

A seventh example cable lacing tie device 610 is illustrated in FIGS. 32-39. The cable lacing tie device 610 includes a head assembly 612 and a length of cable lacing tape 614. The head assembly 612 of this example includes a molded body 616, a retainer 618 in the form of a pivotal compression member having protrusions 624. A first portion 622 of the cable lacing tape 614 is configured to be retained in a first position within the head assembly 612 by having a first end insert-molded within the body 16 in a tortuous path for enhanced retention, as best seen in FIGS. 36 and 37. As shown in this example, it may be necessary for molding purposes to have voids in the body 616 to properly capture the cable lacing tape 614. A length of the cable lacing tape 14 also extends from the front of the head assembly 612. The cable lacing tie device 610 may be used, for example, to hold together a plurality of objects, such as has been described with the prior examples.

Figure 34:
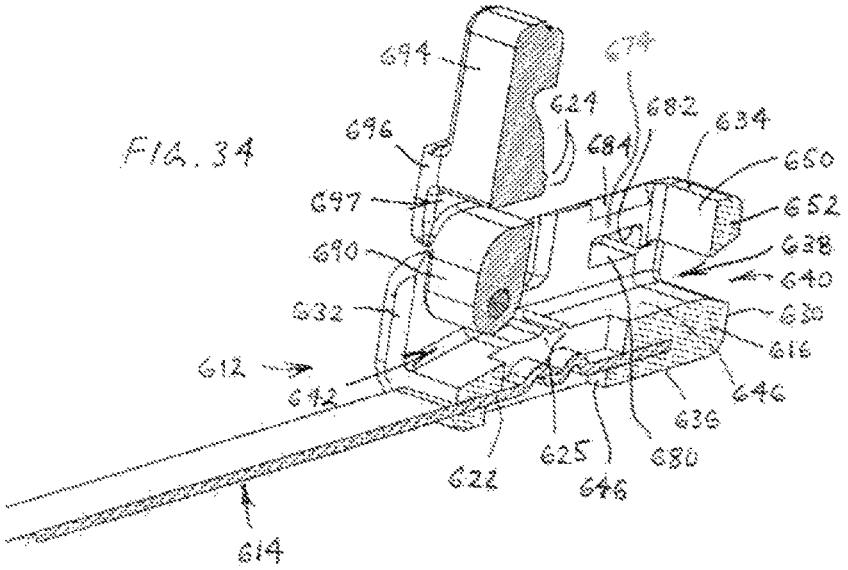
FIG. 34 is a perspective section view of the cable lacing tie device of FIG. 32 having the compression member in an unlocked, ready position, with the device being sectioned parallel to the lacing direction and with a simplified view of the cable lacing tape.
Figure 35:
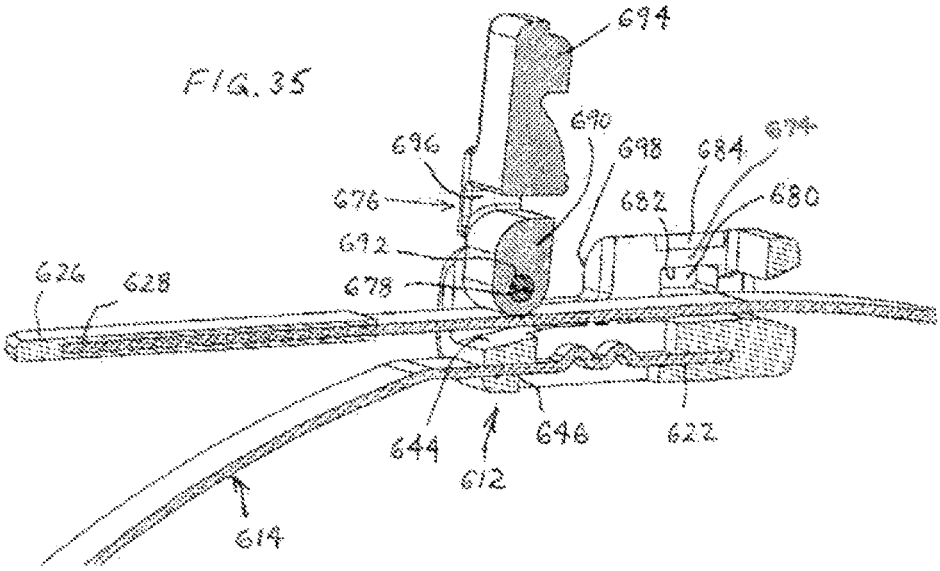
FIG. 35 is a perspective section view of the cable lacing tie device of FIG. 32 having the compression member in an unlocked, ready position and the cable lacing tape being passed through the head assembly, with the device being sectioned parallel to the lacing direction and with a simplified view of the cable lacing tape.

The body 616 and retainer 618 preferably each are injection molded and constructed of a materials and using techniques similar to those described with respect to the earlier examples. In this example, the retainer 618 includes integrally molded protrusions 624 on a surface that engages the cable lacing tape 614 when the retainer 618 is in a locked position. As best seen in FIGS. 34 and 36, the body 616 of this example also includes corresponding protrusions 625 on a lower surface 644 of the body 616 that engage the cable lacing tape 614 and are located opposite the protrusions 624 when the retainer is in a locked position. The protrusions 624, 625 are in the form of laterally extending ribs and provide an increased, localized compression load to enhance the grip on the cable lacing tape 614 without utilizing a destructive or damaging structure. In this manner, the retainer 618 urges a second portion of the cable lacing tape 614 to engage and be retained within the head assembly 612.

The cable lacing tape 614 of this example preferably is constructed similarly to that described in the first and second examples. As with the prior examples, a first portion 622, such as a first end of the cable lacing tape 614 is retained in the head assembly 612, while a tip 626 is molded to the distal or second end 628 of the cable lacing tape 614 that extends from the head assembly 612, as best seen in FIGS. 36 and 37. As with the prior examples, the tip 626 helps to prevent the braided filaments of the cable lacing tape 614 from becoming unraveled, and facilitates insertion of the second end 628 of the cable lacing tape 614 through the head assembly 612.

As best seen in FIG. 34, the body 616 of the head assembly 612 has a rear surface 630, a front surface 632, a top surface 634, a bottom surface 636, and a passageway 638 having an entrance opening 640 and an exit opening 642. The passageway 638 through the body 616 includes the lower surface 644, and a recess 646 in which the cable lacing tape 614 can be seen. The body 616 also includes side walls 674, each having a recess 676 toward the front to receive a pivot pin 678 and a recess 680 toward the rear that receives a locking extension 660 that extends from the side of the retainer 618. Each recess 680 provides an undercut surface 682 for locking engagement with locking extension 660 on the retainer 618. The inner side of the side walls 674 also have a ramped surface 684 that is used in allowing the locking extensions 660 to force the deflect the side walls 674 slightly outward as the locking extensions 660 move downward through the body 616 to come to rest in a locked position in engagement with the undercuts 682.

The retainer 618 includes a base portion 690 having a bore 692 through which the pivot pin 678 extends, thereby pivotally connecting the retainer 618 to the body 616. The retainer 618 also includes a handle portion 694 by which it may be manipulated to pivot from the unlocked, ready position shown in FIGS. 34-36 to the locked position shown in FIG. 37. A central portion 696 bridges between the base portion 690 and the handle portion 694, creating an opening 697 in the retainer 618, while allowing the body 616 to have side openings 698 for expansion of the compressed cable lacing tape 614 and avoiding interference between the retainer 618 and the side walls 674 of the body 616.

Thus the retainer 618 is pivotable from an unlocked, ready position to a locked position. When unlocked and rotated to be perpendicular to the normal path of the cable lacing tape 614, the retainer 618 is in a ready position and permits insertion of the cable lacing tape 614 through the passage 638 in the body 616 to the exit opening 642, where the second end of the cable lacing tape 614 may be grasped and rerouted to go over the base portion 690 of the retainer 618 and rearward through the opening 697 in the retainer 618. As the cable lacing tape 618 extends rearward and above the body 616, the retainer 618 may be pivoted downward toward the body 616, which causes the cable lacing tape 614 to be forced downward by the handle portion 694 and into engagement with the portion extending forward through the passage 638. The cable lacing tape 614 also then becomes wrapped around the handle portion 694 and redirected upward as the retainer reaches the locked position and the cable lacing tape 614 engages the inner surface 650 of a rear wall 652 of the body 616, as best seen in FIGS. 36 and 37. The path of the cable lacing tape 614 through the body 616 and around the various portions of the retainer 618 cause the retainer 618 to act as a cam latch mechanism which tends to be self-binding or self-tightening as further tension is applied to the cable lacing tape 614 that enters the entrance opening 640 in the body 616 of the head assembly 612.

The cable lacing tie device 610 is easily and quickly installed. This is achieved by locating the head assembly 612 at or near a plurality of objects to be held together by the cable lacing tie device 610. The second portion of the cable lacing tape 614 is then moved to a position looped around the plurality of objects, in a plane that is generally perpendicular to the longest axis of the objects, and the second portion of the cable lacing tape 614 is further moved to a position wherein it engages and is retained within the head assembly 612. In this seventh example, this is achieved by the routing shown in FIGS. 34-37, starting with the retainer 618 in an upward, ready position, by moving the distal or second end 628 with the tip 626 to the entrance opening 640 in the rear surface 630 of the body 616 of the head assembly 612. The tip 626 then is inserted into the entrance opening 640 and fed through the passageway 638 in the body 616 until the tip 626 extends outward and forward from the exit opening 642 in the front face 632 of the body 616. The tip 626 is then grasped and the cable lacing tape 614 is pulled until it has reached a desired level of tightness or tension.

As the portion of the cable lacing tape 614 that is extending forward of the exit opening 642 is being pulled, a further more proximal length of the cable lacing tape 614 continues to pass through the passageway 638 and eventually the tension in the cable lacing tape 614 tends to pull the cable lacing tape 614 toward the center of the plurality of objects to be held together, and therefore, into more forceful engagement with the protrusions 625 on the lower surface 644 in the body 616. The tip 626 is then rerouted rearward over the top of the base portion 690 of the retainer 618 and rearward through the opening 697 in the retainer 618. The tip 626 is then routed further rearward, under the handle portion 694 of the retainer 618 and then to extend upward, being further pinched between the handle portion 694 and the inner surface 650 of the rear wall 652 of the body 616 when the retainer 618 is pivoted to the locked position shown in FIG. 37. At this point, the protrusions 624 on the retainer 618, as well as the protrusions 625 on the body 616 of the head assembly 612 serve to provide increased compressive force to assist in holding a second portion of the cable lacing tape 614 within the head assembly 612. The protrusions 624, 625 and other surfaces of the head assembly 612 that engage the cable lacing tape 614, as well as the engagement with itself as it passes back through a portion of the passage 638 do not present a destructive holding environment, as with prior art barbs that would cut into flat plastic cable tie straps. Thus, in the installed and locked position, two portions of the cable lacing tape 614 are retained within the head assembly 612, with a first portion retained within the head assembly 612 in a first general direction and a second portion retained within the head assembly 612 in a second general direction, where the first and second general directions are substantially perpendicular. As with the prior examples, the excess cable lacing tape 614 extending from the head assembly 612 may be trimmed and if one is concerned about the potential unraveling of the cable lacing tape 614, then any of the previously discussed structures or methods may be employed.

Figure 42:
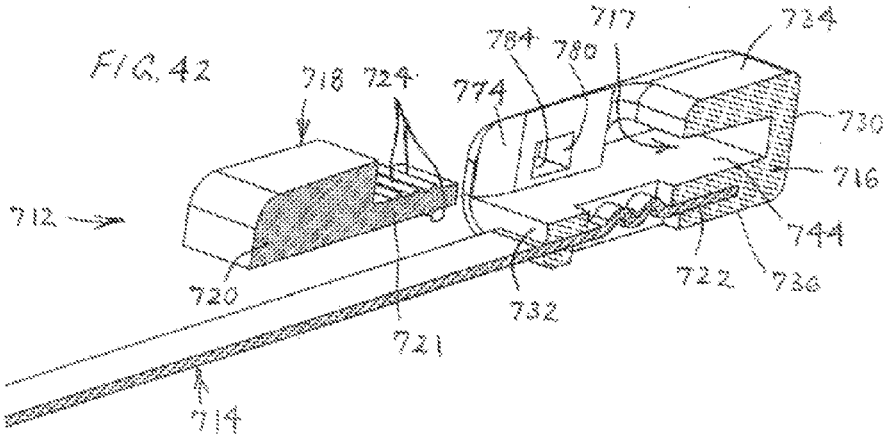
FIG. 42 is a perspective section view of the cable lacing tie device of FIG. 40 having the compression member in an unlocked, ready position, with the device being sectioned parallel to the lacing direction and with a simplified view of the cable lacing tape.

Among other variations from the prior examples, an eighth example cable lacing tie device 710 is illustrated in FIGS. 40-45. This example cable lacing tie device 710 is constructed of similar materials and using similar techniques as described with respect to the prior examples. This example cable lacing tie device 710 includes a head assembly 712 and a length of cable lacing tape 714. The head assembly 712 includes a molded body 716, and a retainer 718 that is shown in this example as a separate piece that is not connected to the body 716 until it is installed in a locked position. As best seen in FIG. 42, the head assembly 712 has a rear surface 730, a front surface 732, a top surface 734, a bottom surface 736. The body 716 includes a wedge-shaped central opening 717, having a lower surface 744. The body further includes side walls 774 having openings 780, which provide undercuts 784. A first portion 722 of the cable lacing tape 714 is molded within the body 716 of the head assembly 712, with a second portion extending outward from the head assembly 712. For ease of manipulation and to prevent unraveling, the cable lacing tape includes a molded tip 726 at a distal or second end 728.

The retainer 718 is installed and held within the head assembly 712 by engagement with the cable lacing tape 714 and compression. The retainer 718 is configured to be a compression member for insertion into the wedge-shaped central opening 717. The retainer 718 further includes a main body 720 and an extension 721. The main body 720 includes locking extensions 760 extending laterally outward therefrom. The locking extensions 760 are configured with a ramped surface 762 to assist in deflecting side walls 774 of the body 716 as the locking extensions 760 are moved toward engagement with the undercuts 784 provided by the openings 780. The extension 721 has integrally molded protrusions 724, in the form of laterally extending ribs, on its upper and lower surfaces. Much like with the prior example cable lacing tie device 610, the protrusions 724 provide a localized increased compressive forces to the second portion of the cable lacing tape 714 to engage and be retained within the head assembly 712.

Figure 43:
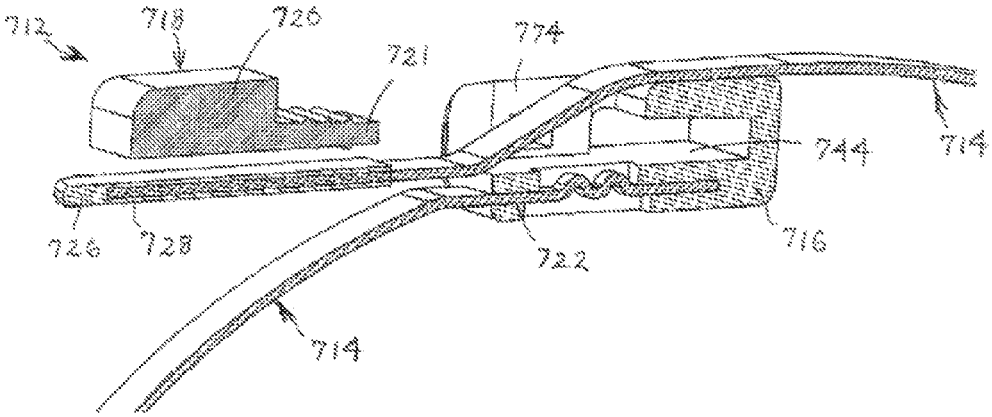
FIG. 43 is a perspective section view of the cable lacing tie device of FIG. 40 having the compression member in an unlocked, ready position and the cable lacing tape being in engagement with and passing over the head assembly, with the device being sectioned parallel to the lacing direction and with a simplified view of the cable lacing tape.
Figure 44:
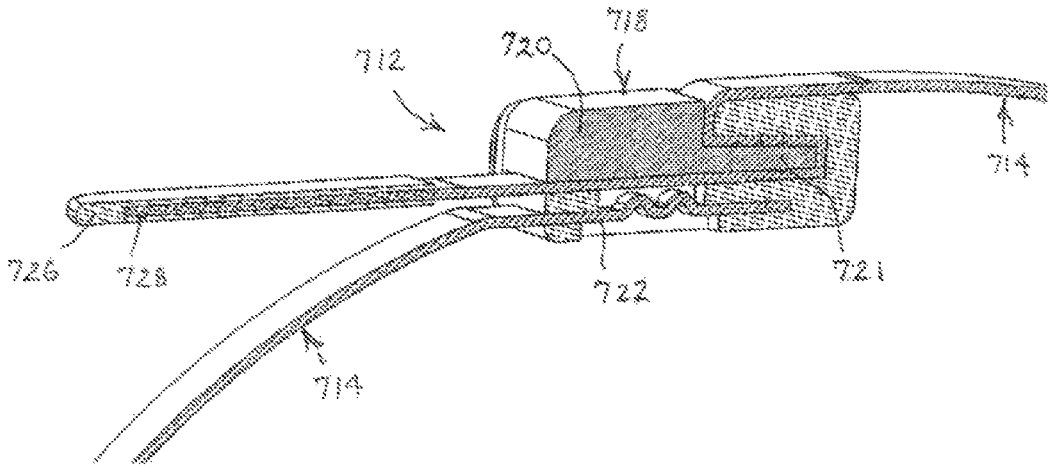
FIG. 44 is a perspective section view of the cable lacing tie device of FIG. 40 having the compression member in a locked position and the cable lacing tape being passed through the head assembly and around the compression member, with the device being sectioned parallel to the lacing direction and with a simplified view of the cable lacing tape.
Figure 45:
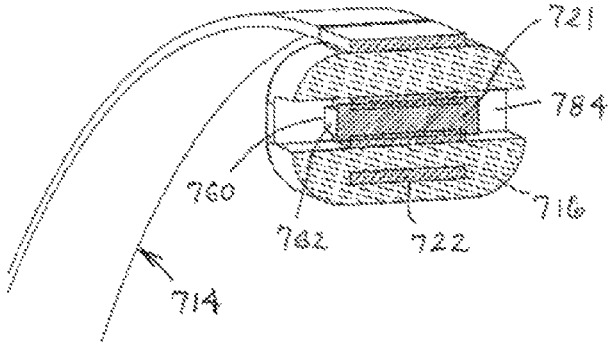
FIG. 45 is a perspective section view of the cable lacing tie device of FIG. 40 having the compression member in a locked position, with the device being sectioned through the compression member at a latch and perpendicular to the lacing direction, and with a simplified view of the cable lacing tape.

Thus, the head assembly 712 is used in a manner similar to the previous examples, however, as noted above, the cable lacing tape 714 does not extend through a passage in the head assembly 712, but rather the cable lacing tape 714 is routed over the top surface 734 of the body 716 and thereby engages and is held within the head assembly 712 by insertion of the retainer 718 until the locking extensions 760 engage the undercuts 784 and the retainer 718 reaches a locked position, as best seen in FIGS. 42-44.

Accordingly, the head assembly 712 and cable lacing tape 714 may be treated in a manner similar to the previous examples to hold together a plurality of objects by locating the head assembly 712 at or near the plurality of objects, moving a second portion of the cable lacing tape 714 to a position looped around the plurality of objects, and then moving the second portion of the cable lacing tape 714 to a position wherein the second portion of the cable lacing tape engages and is retained within the head assembly 712. This is accomplished by routing the cable lacing tape 714 over the body 716, and pulling to tighten the cable lacing tie device 710 around the plurality of objects. The retainer 718 then is inserted into the wedge-shaped opening 717 in the body 716 until it reaches the locked position. Thus, as with the prior examples, when installed, first and second portions of the cable lacing tape 714 are retained within the head assembly 712, with a first portion retained in a first general direction and a second portion retained within the head assembly 712 in a second general direction, where the first and second general directions are substantially parallel. Also, optionally, any excess length of cable lacing tape 714 extending from the head assembly 712 may be removed by cutting the cable lacing tape 714, if desired. As previously described with respect to prior examples, structures and methods of preventing unraveling of the cable lacing tape 714 may be employed.

It will be appreciated that various modifications may be made to the structures described or required within a cable lacing tie device, while still falling within the spirit and scope of the claimed subject matter. For example, while the protrusions are shown extending from retainers that do not impart compression, they could extend instead from retainers that also serve as a compression member. Similarly, while the third example shows a pair of oppositely facing head assemblies, it will be appreciated that two head assemblies could be stacked, or could be integrated to share components, such as a single retainer plate having protrusions extending upward and downward. structures and methods of preventing unraveling of the cable lacing tape 714 may be employed.

Thus, one may construct a cable lacing tie device comprising a head assembly and a cable lacing tape, the head assembly retaining a first portion of the cable lacing tape and having a length of the cable lacing tape extending from the head assembly, and the head assembly further comprising a retainer adapted to retain a portion of the length of cable lacing tape extending from the head assembly.

The present disclosure relates in another aspect to the device of paragraph 0110, wherein when the cable lacing tie device is installed, the first portion of the cable lacing tape that is retained within the head assembly extends in a first general direction and a second portion of the cable lacing tape is retained within the head assembly and extends in a second general direction, wherein the first and second general directions are substantially parallel or substantially perpendicular.

The present disclosure relates in a further aspect to the device of paragraph 0110, wherein the cable lacing tape further comprises a braided filament structure.

The present disclosure relates in yet another aspect to the device of paragraph 0110, wherein the cable lacing tape includes at least one molded tip.

The present disclosure relates in a further aspect to the device of paragraph 0110, wherein the cable lacing tape includes at least one molded segment positioned along the length of the cable lacing tape.

The present disclosure relates in another aspect to the device of paragraph 0110, wherein the retainer is disposed within a recess in the head assembly.

The present disclosure relates in yet another aspect to the device of paragraph 0110, wherein the retainer is integrally within into the head assembly.

The present disclosure relates in a further aspect to the device of paragraph 0110, wherein the retainer is positioned in the head assembly above and below the cable lacing tape.

The present disclosure relates in another aspect to the device of paragraph 0110, wherein the retainer is pivotable.

The present disclosure relates in another aspect to the device of paragraph 0110, wherein the head assembly further comprises a compression member.

The present disclosure relates in a further aspect to the device of paragraphs 0110 and 0119, wherein the compression member is integrally molded within the head assembly.

The present disclosure relates in a further aspect to the device of paragraphs 0110 and 0119, wherein the compression member is disposed within the head assembly and configured to be movable from a ready position that does not obstruct movement of the cable lacing tape to a locked position that engages the cable lacing tape.

The present disclosure relates in a further aspect to the device of paragraphs 0110 and 0119, wherein the compression member is pivotal.

The present disclosure relates in another aspect to the device of paragraphs 0110 and 0119, wherein the compression member is configured to be inserted into a wedge shaped opening within the head assembly.

The present disclosure relates in a further aspect to the device of paragraphs 0110 and 0119, wherein the head assembly further comprises a body and the compression member is configured to be inserted into the body.

Additionally, one may construct a cable lacing tie device comprising a head assembly, a cable lacing tape, and a retainer adapted to urge a portion of the cable lacing tape into a retained position within the head assembly.

The present disclosure relates in a further aspect to the device of paragraph 0125, wherein the retainer is integrally molded as part of the head assembly.

Thus, although the present disclosure describes particular example embodiments, it is to be understood that the disclosure is not to be interpreted as limiting. Various alterations and modifications will become apparent to those skilled in the art after having read the above disclosure. Accordingly, it is intended that the appended claims be interpreted as covering all alterations and modifications that fall within the true spirit and scope of the invention.

We claim:

1. A cable lacing tie device comprising:

a cable lacing tape; and a head assembly comprising:

a body having a rear surface, a front surface, a top surface, a bottom surface, and a passageway having an entrance opening and an exit opening, the passageway through the body including a lower surface, and a recess in which the cable lacing tape can be located; and a retainer in the form of a pivotal compression member, the retainer pivotally coupled to the body wherein the retainer is pivotable between an unlocked, ready position and a locked position such that when the retainer is in the unlocked, ready position, the retainer permits insertion of an end of the cable lacing tape through the passageway in the body from the entrance opening to the exit opening and routable through an opening in the retainer, and when the retainer is in the locked position, the path of the cable lacing tape through the body and the retainer cause the retainer to act as a cam latch mechanism, wherein the body further comprises:

side walls, each having a side wall recess to receive a pivot pin for pivotally mounting the retainer to the body; and a locking recess that receives a locking extension that extends from the retainer, the locking recess providing an undercut surface for locking engagement with the locking extension extending from the retainer, wherein an inner surface of the side wall has a ramped surface to allow the locking extension to deflect the side wall outward as the retainer and the locking extension move into the locked position and into engagement with the undercut.

2. A cable lacing tie device as recited in claim 1, wherein a second end of the cable lacing tape is configured to be retained within the head assembly.

3. A cable lacing tie device as recited in claim 1, wherein the retainer further comprises protrusions for frictionally engaging the cable lacing tape.

* * * * *